US011276274B2

(12) United States Patent
Imura et al.

(10) Patent No.: US 11,276,274 B2
(45) Date of Patent: Mar. 15, 2022

(54) PAPER STOCK PROCESSING SYSTEM AND PAPER STOCK PROCESSING DEVICE

(71) Applicant: Universal Entertainment Corporation, Tokyo (JP)

(72) Inventors: Hideaki Imura, Tokyo (JP); Kunihiro Manabe, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 30 days.

(21) Appl. No.: 16/713,138

(22) Filed: Dec. 13, 2019

(65) Prior Publication Data

US 2020/0202666 A1 Jun. 25, 2020

(30) Foreign Application Priority Data

Dec. 19, 2018 (JP) ..... JP2018-236967

(51) Int. Cl.
*G07F 17/32* (2006.01)

(52) U.S. Cl.
CPC ..... *G07F 17/3234* (2013.01); *G07F 17/3216* (2013.01); *G07F 17/3223* (2013.01); *G07F 17/3246* (2013.01); *G07F 17/3213* (2013.01); *G07F 17/3241* (2013.01)

(58) Field of Classification Search
CPC ..... G07F 17/3216; G07F 17/3223; G07F 17/3234; G07F 17/3246; G07F 17/3248; G07F 17/3251; G07F 17/42
See application file for complete search history.

(56) References Cited

U.S. PATENT DOCUMENTS 3,813,500 A * 5/1974 Roberts ..... H02G 15/28 379/33
4,039,768 A * 8/1977 O'Maley ..... H04M 1/24 379/33
4,041,243 A * 8/1977 Zarouni ..... H04M 17/023 379/147
4,365,700 A * 12/1982 Arimoto ..... G07D 11/13 194/206
4,840,368 A * 6/1989 Uehara ..... G07D 11/12 271/162

(Continued)

FOREIGN PATENT DOCUMENTS

JP 2005018644 A 1/2005

*Primary Examiner* — Steven J Hylinski
(74) *Attorney, Agent, or Firm* — Potomac Law Group, PLLC; Kenneth Fagin

(57) ABSTRACT

It is possible to accurately detect that paper stock stored in a container reaches a limit number. A paper stock processing system includes: a banknote processing device which includes a banknote accommodation unit accommodating banknotes, updates the accumulated number each time a banknote is accommodated, and transmits an updated accumulated number signal; a smart interface board which transmits the accumulated number signal to the outside when receiving the accumulated number signal; and a management server which compares the accumulated number indicated by the accumulated number signal with the maximum number and detects whether the number of accommodated banknotes has reached a limitation number set to the banknote accommodation unit 100, when receiving the accumulated number signal from a PTS terminal.

7 Claims, 15 Drawing Sheets

(56) References Cited

U.S. PATENT DOCUMENTS

| | | | | | |
|---|---|---|---|---|---|
| 4,866,254 | A * | 9/1989 | Okayama | G07F 19/211 | 235/379 |
| 4,889,978 | A * | 12/1989 | Koshida | G07D 11/40 | 235/379 |
| 5,350,165 | A * | 9/1994 | Nagamoto | B65H 1/06 | 271/9.01 |
| 5,419,423 | A * | 5/1995 | Ishida | G07F 7/04 | 194/206 |
| 6,356,794 | B1 * | 3/2002 | Perin, Jr. | G07F 9/002 | 700/78 |
| 2002/0025065 | A1 * | 2/2002 | Yamamoto | G07D 11/50 | 382/135 |
| 2003/0137095 | A1 * | 7/2003 | Ito | B65H 31/26 | 271/176 |
| 2004/0149537 | A1 * | 8/2004 | Pai | G07D 7/00 | 194/203 |
| 2004/0185937 | A1 * | 9/2004 | Takeda | G07F 17/32 | 463/42 |
| 2006/0084502 | A1 * | 4/2006 | Downs | G07F 17/3232 | 463/29 |
| 2007/0119684 | A1 * | 5/2007 | Yang | G07D 11/13 | 194/350 |
| 2011/0049796 | A1 * | 3/2011 | Nireki | B65H 29/46 | 271/264 |
| 2011/0198191 | A1 * | 8/2011 | Nireki | B65H 43/04 | 194/206 |
| 2011/0230268 | A1 * | 9/2011 | Williams | G07F 17/3225 | 463/42 |
| 2013/0285838 | A1 * | 10/2013 | Balaban | G07F 17/3232 | 340/870.07 |
| 2016/0023120 | A1 * | 1/2016 | Balaban | G07F 17/3225 | 463/29 |

* cited by examiner

FIG.9

MAXIMUM NUMBER TABLE

| STACKER TYPE | ACCOMMODATION STAGE | MAXIMUM NUMBER | ALLOWABLE NUMBER |
|---|---|---|---|
| A | — | 490 | 500 |
| B | B1 | 195 | 200 |
| B | B2 | 95 | 100 |
| B | B3 | 95 | 100 |
| B | B4 | 95 | 100 |
| C | — | 980 | 1000 |
| ... | ... | ... | ... |

FIG.10

BANKNOTE CONTAINER MANAGEMENT TABLE

| STACKER IDENTIFICATION NUMBER | SLOT MACHINE IDENTIFICATION NUMBER | BANKNOTE PROCESSING DEVICE IDENTIFICATION NUMBER | STACKER TYPE | ACCOMMODATION STAGE | ACCUMULATED NUMBER | STATUS |
|---|---|---|---|---|---|---|
| ... | ... | ... | ... | ... | ... | ... |
| A0210561 | 00153262 | 00001324 | A | – | 500 | STOPPED |
| B0000782 | 52012354 | 01001236 | B | B1 | 134 | IN PROGRESS |
| B0000782 | 52012354 | 01001236 | B | B2 | 25 | IN PROGRESS |
| B0000782 | 52012354 | 01001236 | B | B3 | 12 | IN PROGRESS |
| B0000782 | 52012354 | 01001236 | B | B4 | 5 | IN PROGRESS |
| C0005483 | 00002623 | 02364475 | C | – | 990 | WARNING |
| A0210561 | – | – | A | – | 498 | STORED |
| ... | ... | ... | ... | ... | ... | ... |

PAPER STOCK PROCESSING SYSTEM AND PAPER STOCK PROCESSING DEVICE

CROSS-REFERENCE TO RELATED APPLICATION

The present application claims priority from Japanese Patent Application No. 2018-236967, which was filed on Dec. 19, 2018, the disclosure of which is herein incorporated by reference in its entirety.

BACKGROUND OF THE INVENTION

1. Field of the Invention

The present invention relates to a paper stock processing system and a paper stock processing device.

2. Description of Related Art

Paper stock processing devices such as banknote processing devices are, for example, embedded in service equipment, a gaming machine installed in a gaming facility, and a vending machine or a ticket machine installed in a public place, each of which is configured to identify the validity of a banknote inserted into an insertion slot by users, and provide a service or product in accordance with the value of a banknote which is identified to be valid. Such a banknote processing device is typically arranged to identify the validity of a banknote inserted through the insertion slot and store a valid banknote in a detachable container (safe).

In the banknote processing device, as disclosed in Japanese Laid-Open Patent Publication No. 2005-18644, for example, a storage unit is provided in the container to check if the inserted banknote is matched with the banknote actually stored in the container. To be more specific, a banknote identification control circuit board is provided in a banknote identifier on the device main body side whereas a banknote container control circuit board is provided on the container side, and these circuit boards are arranged to communicate with each other via a connector terminal. To put it differently, information regarding an inserted banknote is sent from the banknote identification control circuit board to the banknote container control circuit board and the banknote information is stored in a storage unit mounted on the board, with the result that the information of the banknote actually stored in the container is stored and managed.

In the above-described known banknote processing device, a sensor is provided in the container and the number of banknotes is approximated by measuring the thickness of the wad of banknotes. When the measured thickness of the wad of banknotes exceeds predetermined thickness, typically a warning signal is sent to an apparatus in which the banknote processing device is embedded, and the signal is transferred to an external apparatus through the apparatus. Because communications between a management server and the apparatus in which the banknote processing device is embedded are typically standardized in the industry, the content of communication data is limited to, for example, information indicating that the thickness of the wad of banknotes exceeds predetermined thickness as in the known device described above.

Under this circumstance, the external apparatus is required to detect that the paper stock stored in the container reaches the maximum number based on such limited information. However, misdetection occurs due to various reasons such as wrinkles and stains on banknotes and common difference in thickness.

SUMMARY OF THE INVENTION

An object of the present invention is to provide a paper stock processing system and a paper stock processing device which are able to accurately detect that paper stock stored in a container reaches a limit number.

A paper stock processing system of the present invention includes: a paper stock processing device including:

an accommodation unit which accommodates paper stock inserted into an insertion slot;

a paper stock information storage unit (IC tag) configured to store the accumulated number of the paper stock accommodated in the accommodation unit;

a control unit configured to update the accumulated number stored in the storage unit each time the paper stock is accommodated in the accommodation unit; and an accumulated number signal transmitter configured to transmit an accumulated number signal indicating the accumulated number updated by the control unit;

a mediation device which includes a mediation-device-side transceiver unit which is configured to control sending and receiving of signals to and from the outside and transmit the accumulated number signal to the outside when receiving the accumulated number signal from the paper stock processing device; and an external apparatus including: an external-apparatus-side receiver configured to receive a signal from the outside;

a setting information storage unit configured to store a maximum number which is set in advance; and a detection unit which, when the external-apparatus-side receiver receives the accumulated number signal from the mediation device, compares the accumulated number indicated by the accumulated number signal with the maximum number and determines whether the number of the paper stock has reached a limitation number set to the accommodation unit.

According to the arrangement above, communications between the paper stock processing device and the external apparatus are performed through the mediation device, the accumulated number sent from the paper stock processing device to the mediation device is sent from the mediation device to the external apparatus, and the external apparatus compares the accumulated number with the maximum number to determine whether the number of paper stock in the accommodation unit of the paper stock processing device has reached the limitation number. A paper stock processing device is typically connected directly to a controller which utilizes information read from paper stock by a paper stock processing device. Meanwhile, in the arrangement above, communications between the controller and the paper stock processing device, communications between the controller and the external apparatus, and communications between the paper stock processing device and the external apparatus are performed through the intermediary of the mediation device. For this reason, even when the communications between the controller and the external apparatus are performed in accordance with a predetermined standard, the communications between the paper stock processing device and the external apparatus through the intermediary of the mediation device are performed with a certain degree of freedom, apart from the communications in accordance with the standard. Because the accumulated number of the paper stock detected by the paper stock processing device can be sent to the external apparatus without any modification, it is possible to precisely detect that the number of paper stock accommodated in the accommodation unit has reached the limitation number.

The paper stock processing system of the present invention further includes a gaming machine in which the paper stock processing device and the mediation device are provided, the paper stock processing device further including: a reader unit which is provided in the gaming machine to allow the paper stock to be inserted into the insertion slot from the outside; and a paper stock information transmitter which is configured to send a paper stock information signal indicating paper stock information to the mediation device, when the mediation-device-side transceiver unit receives the paper stock information signal, the mediation device transmitting the paper stock information signal to the gaming machine, and the gaming machine including a game running unit which runs a game based on the paper stock information indicated by the paper stock information signal, when receiving the paper stock information signal from the external-apparatus-side receiver.

According to the arrangement above, the paper stock processing device and the mediation device are included in the gaming machine which runs a game based on paper stock information read by the paper stock processing device. Because the paper stock processing device and the mediation device are provided for and included in each gaming machine, a possibility of physical contact from the outside is decreased, and security in communications is improved.

A paper stock processing device of the present invention includes:

a reader unit configured to read information from paper stock inserted into an insertion slot;

an accommodation unit configured to accommodate the paper stock read by the reader unit;

a storage unit configured to store the accumulated number of the paper stock accommodated in the accommodation unit;

a control unit configured to update the accumulated number stored in the storage unit each time the paper stock is accommodated in the accommodation unit; and a transmitter configured to transmit a warning signal to an external apparatus when the accumulated number updated by the control unit reaches a limitation number set to the accommodation unit.

According to the arrangement above, the accumulated number in the storage unit is updated each time paper stock is accommodated in the accommodation unit, and a warning signal is transmitted to the external apparatus when the accumulated number reaches the limitation number set to the accommodation unit. Because the accumulated number of paper stock accommodated in the accommodation unit is updated each time paper stock is accommodated and a warning signal is output based on the accumulated number, it is possible to correctly detect that the number of paper stock accommodated in the container has reached the limit.

It is possible to accurately detect that paper stock stored in a container reaches a limit number.

BRIEF DESCRIPTION OF THE DRAWINGS

FIG. 9 is an explanatory diagram of a maximum number table.

FIG. 10 is an explanatory diagram of a banknote container management table.

DETAILED DESCRIPTION OF EMBODIMENTS OF THE INVENTION

Figure 1:
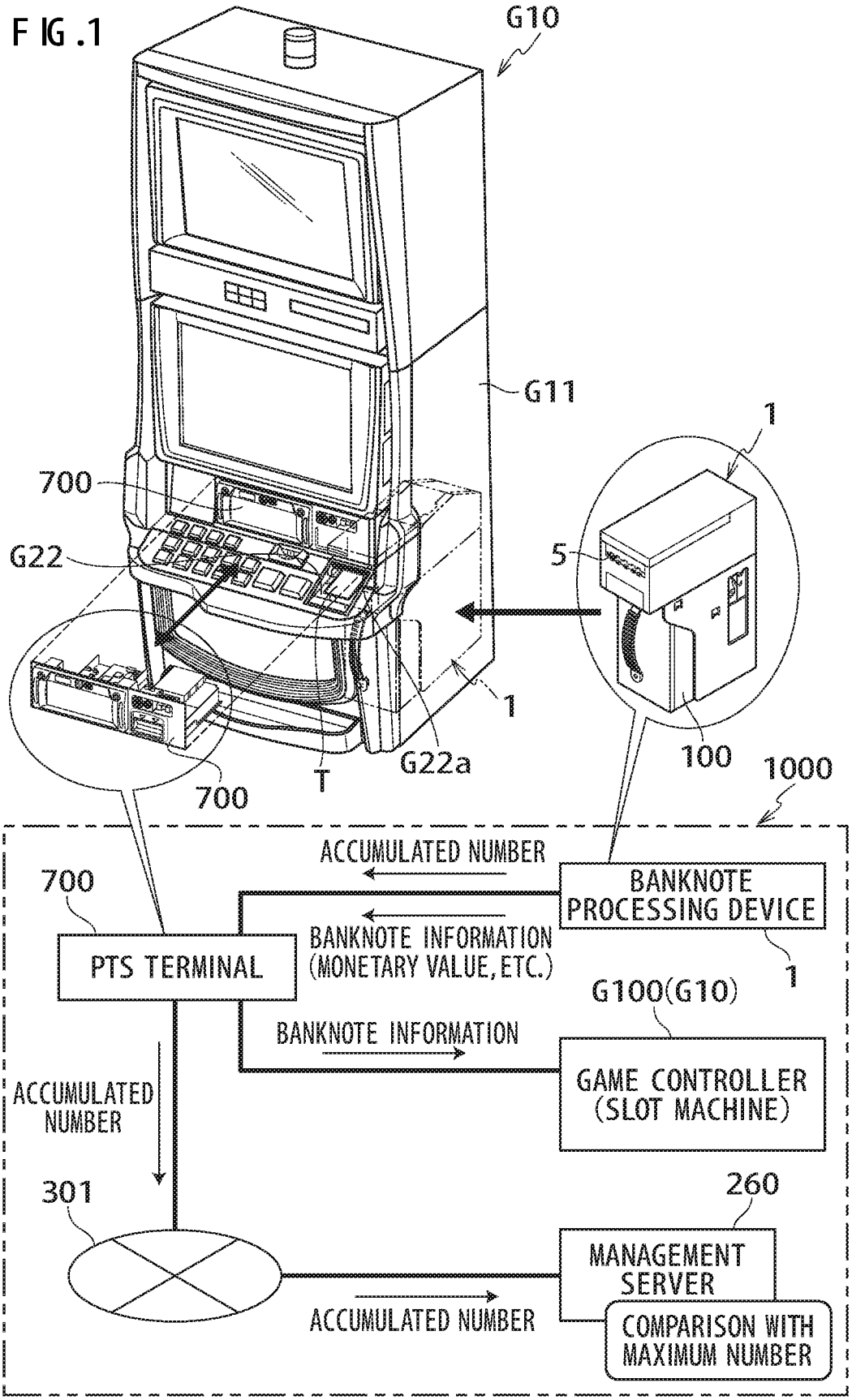
FIG. 1 illustrates the outline of a banknote processing system.

As shown in FIG. 1, a banknote processing system 1000 of an embodiment includes a banknote processing device 1 which is a paper stock processing device, a management server 260 which is an external apparatus, and a PTS terminal 700 which is a mediation device.

The banknote processing device 1 is capable of storing banknotes which are a type of paper stock, and is detachably provided in a cabinet 11 of a slot machine 10. The banknote processing device 1 includes a banknote accommodation unit (banknote stacker) 100 which is an accommodation unit in which banknotes inserted into a banknote insertion slot 5 which is an insertion slot are accommodated. The banknote processing device 1 is arranged to count the number of banknotes each time a banknote is stored in the banknote accommodation unit 100, and accumulatively store the accumulated number of banknotes. Furthermore, the banknote processing device 1 is arranged to acquire banknote information indicating a monetary value, etc. from a banknote inserted into the banknote insertion slot 5.

Banknotes are a type of currency. The term "currency" encompasses not only legal currencies issued by governments but also local currencies each used in a particular community and international currencies transacted internationally, such as Euro and United States Dollar. The term "currency circulation zone" indicates a geographical range in which the currency is used for transaction. For example, in case of a currency circulated in a country, the range within the border of the country is the currency circulation zone. In case of a common currency circulated in an area constituted by a plurality of countries, the area is the currency circulation zone. Furthermore, in case of a currency circulated in a region of a country, the region is the currency circulation zone.

In the present embodiment, the banknote processing device 1 is embedded in a slot machine G10 which is a gaming machine. The slot machine G10 has a cabinet G11, and the cabinet G11 has a bill entry G22 having an insertion slot G22*a* through which banknotes from the outside are received. Banknotes are therefore received by the banknote processing device 1 through the insertion slot G22*a* of the bill entry G22.

The banknote processing device 1 is provided in the cabinet G11 so that the banknote insertion slot 5 corresponds to the insertion slot G22*a* of the bill entry G22. In this way, the banknote processing device 1 receives a banknote T inserted through the insertion slot 22*a* of the bill entry 22. As such, the banknote processing device 1 is embedded in the slot machine G10 so that banknotes can be inserted into the banknote insertion slot 5 from the outside.

A PTS terminal 700 is inserted into the cabinet G11 from the front surface side of the slot machine G10 and is embedded in the slot machine G10 so as to form a part of the front surface of the cabinet G11. The PTS terminal 700 is arranged to perform mediation in data communications between devices in the banknote processing system 1000. To be more specific, the PTS terminal 700 is connected to each of the banknote processing device 1 and a game controller G100 controlling processes executed by the slot machine G10, so as to be able to perform data communications with the connected devices. Further, the PTS terminal 700 is connected to the management server 260 through a communication line 301.

In the banknote processing system 1000 arranged as described above, the banknote processing device 1 sends, to the PTS terminal 700, a signal (hereinafter, accumulated number signal) which indicates the accumulated number of banknotes T accommodated in the banknote accommodation unit 100. When receiving an accumulated number signal, the PTS terminal 700 sends the accumulated number signal to the management server 260. As such, the PTS terminal 700 mediates data communication from the banknote processing device 1 to the management server 260.

In addition to the above, the banknote processing device 1 sends, to the PTS terminal 700, a signal (hereinafter, banknote information signal) indicating banknote information read from an inserted banknote T. When receiving a banknote information signal, the PTS terminal 700 sends the banknote information signal to the slot machine G10. As such, the PTS terminal 700 mediates data communication from the banknote processing device 1 to the slot machine G10.

Although not illustrated in FIG. 1, the slot machine G10 sends, to the PTS terminal 700, a signal (hereinafter, game information signal) indicating information of a game run by the game controller G100 based on banknote information. When receiving a game information signal, the PTS terminal 700 sends the game information signal to the management server 260. As such, the PTS terminal 700 mediates data communication from the banknote processing device 1 to the management server 260.

When receiving an accumulated number signal, the management server 260 compares the accumulated number indicated by the accumulated number signal with the maximum number which is stored in advance and indicates the maximum number of banknotes accommodated in the banknote accommodation unit 100, and determines whether the accumulated number has reached the limitation number set to the banknote accommodation unit 100. The maximum number and the limitation number are not limited to the maximum number of banknotes which can be physically accommodated in the banknote accommodation unit 100. These numbers may be a predetermined number which is set in advance by an administrator who manages the banknote processing system 1000, for example.

In the present embodiment, the game information signal sent from the PTS terminal 700 to the management server 260 is data which is structured in accordance with a predetermined standard. In other words, the data of the game information signal is constructed in the slot machine G10 or the PTS terminal 700 in accordance with a predetermined standard. Therefore the term "mediation" indicates mediation of information. The PTS terminal 700 may execute processes such as construction of data based on information indicated by a signal sent from the slot machine G10 or the management server 260.

While the banknote processing device 1 of the present embodiment is embedded in the gaming machine, the disclosure is not limited to this arrangement. For example, the banknote processing device 1 may be a terminal device connected to an external apparatus such as a money exchanger, a vending machine, and a ticket machine. The banknote processing device 1 may not be embedded in such a terminal device. While in the present embodiment the paper stock processing device is provided for each terminal device, one paper stock processing device may be provided for plural terminal devices. When a gaming machine includes plural terminal devices, the banknote processing device 1 may be provided for each of the terminal devices.

The management server 260 may be composed of plural devices disposed at different locations. For example, an external apparatus receiving an accumulated number signal may be different from an external apparatus receiving a game information signal.

As described above, in the banknote processing system 1000 of the present embodiment, the banknote processing device 1 which is a paper stock processing device includes the banknote accommodation unit 100 which accommodates banknotes inserted into the banknote insertion slot 5, stores the accumulated number of banknotes accommodated in the banknote accommodation unit 100, and updates the accumulated number and sends an accumulated number signal indicating the accumulated number each time a banknote is accommodated in the banknote accommodation unit 100. The PTS terminal 700 which is a mediation device controls sending and receiving of signals to and from the outside. When receiving an accumulated number signal output from the banknote processing device 1, the PTS terminal 700 sends the accumulated number signal to the outside. The management server 260 which is an external apparatus receives signals from the outside and stores the maximum number which is set in advance, and when receiving an accumulated number signal from the PTS terminal 700, the management server 260 compares the accumulated number indicated by the accumulated number signal with the maximum number and determines whether the number of banknotes has reached the limitation number set to the banknote accommodation unit 100.

In other words, communications between the banknote processing device 1 and the management server 260 are performed through the PTS terminal 700, the accumulated number sent from the banknote processing device 1 to the PTS terminal 700 is sent from the PTS terminal 700 to the management server 260, and the management server 260 compares the accumulated number with the maximum number to determine whether the number of paper stock in the banknote accommodation unit 100 of the banknote processing device 1 has reached the limitation number. A paper stock processing device such as the banknote processing device 1 is typically connected directly to a controller which utilizes information read from paper stock by a paper stock processing device. Meanwhile, in the present embodiment, communications between the slot machine G10 and the banknote processing device 1, communications between the slot machine G10 and the management server 260, and communications between the banknote processing device 1 and the management server 260 are performed through the intermediary of the PTS terminal 700. For this reason, even when the communications between the slot machine G10 and the management server 260 are performed in accordance with a predetermined standard, the communications between the banknote processing device 1 and the management server 260 through the intermediary of the PTS terminal 700 are performed with a certain degree of freedom, apart from the communications in accordance with the standard. Because the accumulated number of banknotes detected by the banknote processing device 1 can be sent to the management server 260 without any modification, it is possible to precisely detect that the number of banknotes accommodated in the banknote accommodation unit 100 has reached the limitation number.

The following will specifically describe the mechanical structure of the banknote processing device 1 of the present embodiment.

Figure 2:
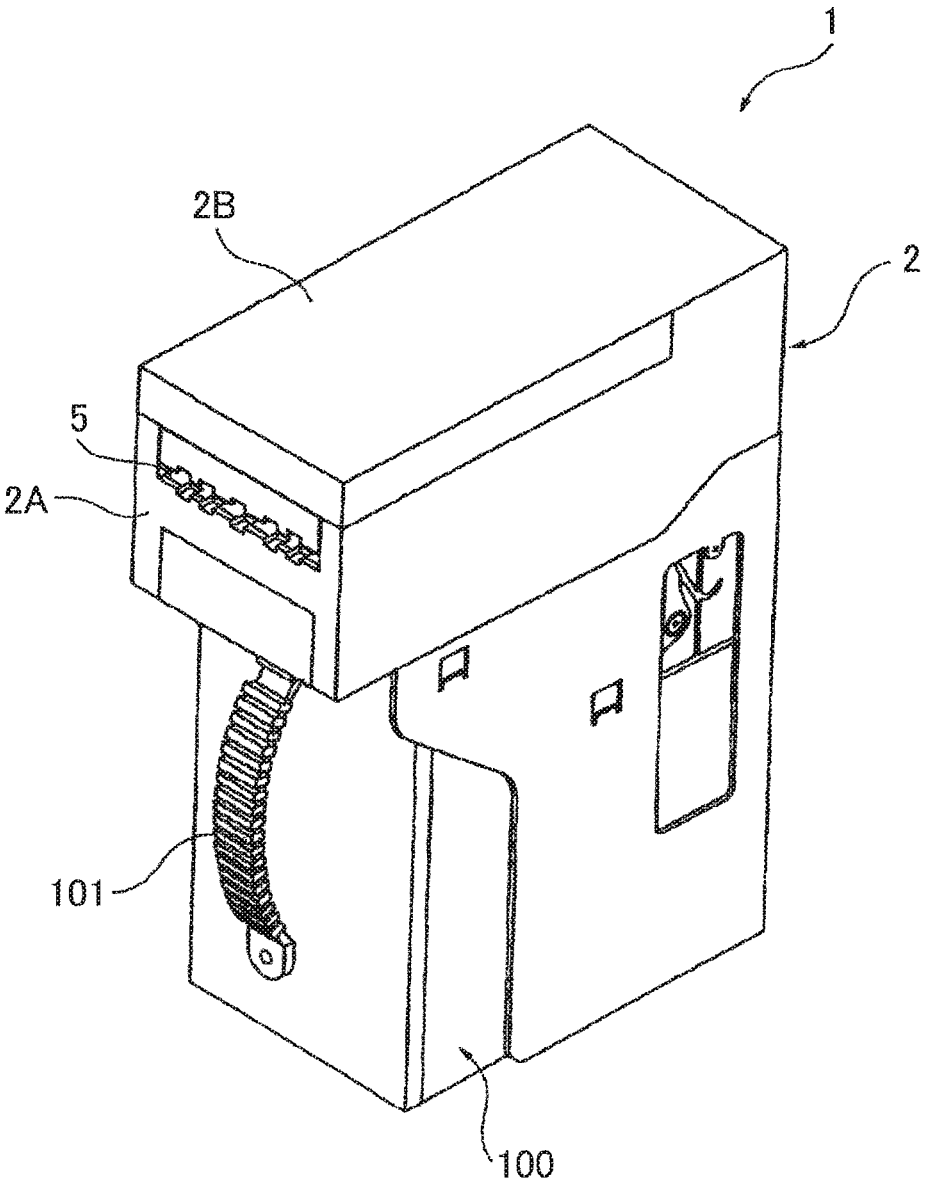
FIG. 2 illustrates the structure of a banknote processing device, and is a perspective view showing the overall structure.

As shown in FIG. 2, the banknote processing device 1 includes a device main body 2. The above-described banknote accommodation unit 100 is provided in this device main body 2 and is capable of storing a large number of banknotes in a stacked manner. The banknote accommodation unit 100 has a function as a safe, and is detachably attached to a frame 2A which is a part of the device main body 2. In the present embodiment, for example, the banknote accommodation unit 100 is detached from the frame 2A of the device main body 2 in such a way that a handle 101 on the front surface is pulled after an unillustrated lock mechanism is unlocked. When, for example, the number of banknotes accommodated in the banknote accommodation unit 100 reaches the maximum number, the banknote accommodation unit 100 is detached from the slot machine G10 by pulling the handle 101, and another banknote accommodation unit 100 in which no banknote is accommodated is attached to the frame 2A. This shortens time required for maintenance of the slot machine G10 and prevents the decrease in operation rate.

The device main body 2 includes the frame 2A and a door 2B which is arranged to be rotationally opened or closed about one end portion of the frame 2A. The main body frame 2A and the door 2B are arranged so that, when the door 2B is closed with respect to the body frame 2A, a gap (banknote conveyance path) where banknotes are conveyed is formed between these members, and the banknote insertion slot 5 is formed to match the banknote conveyance path, on the side on which the members are exposed on the front surface. The banknote insertion slot 5 is a slit allowing banknotes to be inserted into the device main body 2 with the short side of each banknote being the leading end.

Figure 3:
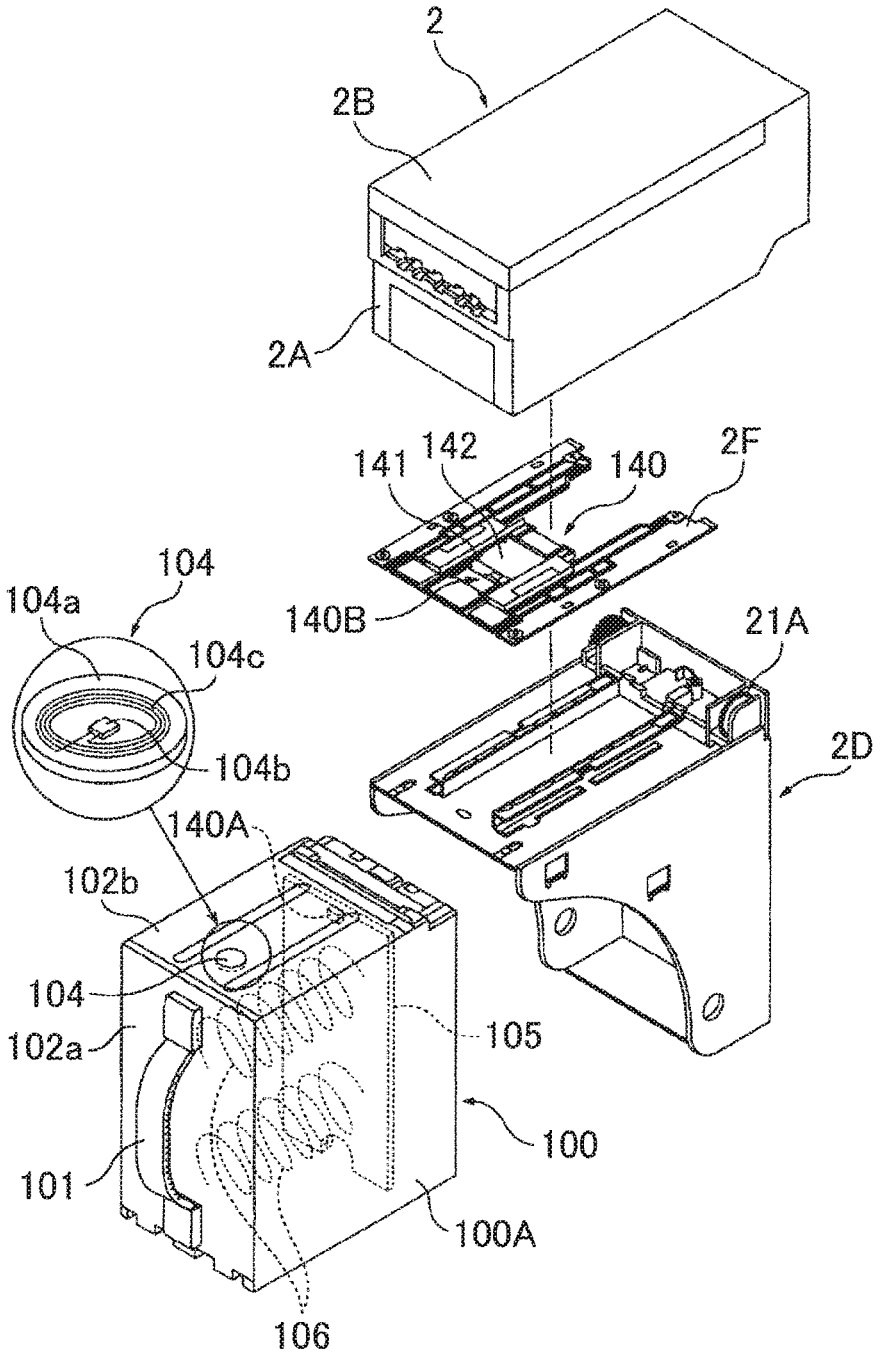
FIG. 3 is an exploded perspective view of a banknote processing device.

As shown in FIG. 3, the banknote processing device 1 is mainly composed of three structures. In other words, the banknote processing device 1 includes the device main body 2, a stand (frame member) 2D to which the device main body 2 is detachably attached, and the banknote accommodation unit 100 which is detachably attached to the stand 2D.

In the banknote processing device 1, a plate 2F is integrally attached to the back surface side of the device main body 2. On the plate 2F, a circuit board 141 on which a magnetic sensor 140, a reader-writer 142, etc. are mounted is provided. The reader-writer 142 reads banknote information from and writes banknote information to an RFID (Radio Frequency Identification) tag 104 which is a paper stock information storage unit provided at an upper wall 102*b* of the banknote accommodation unit 100. The plate 2F is provided between the frame 2A and a surface of the stand 2D constituting the device main body, and is fixed to both the frame 2A and the stand 2D. While in the present embodiment the paper stock information storage unit is an RFID tag, the disclosure is not limited to this arrangement.

The RFID 104 has a function of storing information related to a banknote sent from the device main body 2 side, etc., in a contactless manner. That is to say, the RFID 104 stores banknote information read from banknotes accommodated in the banknote processing device 1 and accumulated number information. The accumulated number information indicates the accumulated number of banknotes accommodated in the banknote accommodation unit 100 and is updated each time a banknote is accommodated in the banknote processing device 1.

The RFID 104 includes an IC chip 104*b* mounted on a board 104*a* made of an insulating material and a coil antenna 104*c* which is printed on the board 104*a* and has terminals connected to the IC chip 104*b*. While the RFID 104 composed of the ID tag in the case above is a passive type not including a battery, the RFID 104 may be an active type including a battery, as a matter of course.

The reader-writer 142 which writes banknote information and accumulated number information into the RFID 104 is, as described above, provided on the circuit board 141 of the plate 2F attached to the back surface side of the device main body 2. The reader-writer 142 is separated from the RFID 104 at a predetermined interval, and sends banknote information, etc. to the RFID 104 in a wireless manner. Although not detailed in the figures, the reader-writer 142 provided on the circuit board 141 includes a communication controller which is composed of passive components such as an IC chip and an LCR, an antenna which is connected to the communication controller and sends banknote information, etc. to the coil antenna 104*c* of the RFID 104, and a matching circuit which performs matching in accordance with the frequency of an electromagnetic wave used for the communication and the impedance of input and output. These components are mounted on the circuit board 141.

Figure 4:
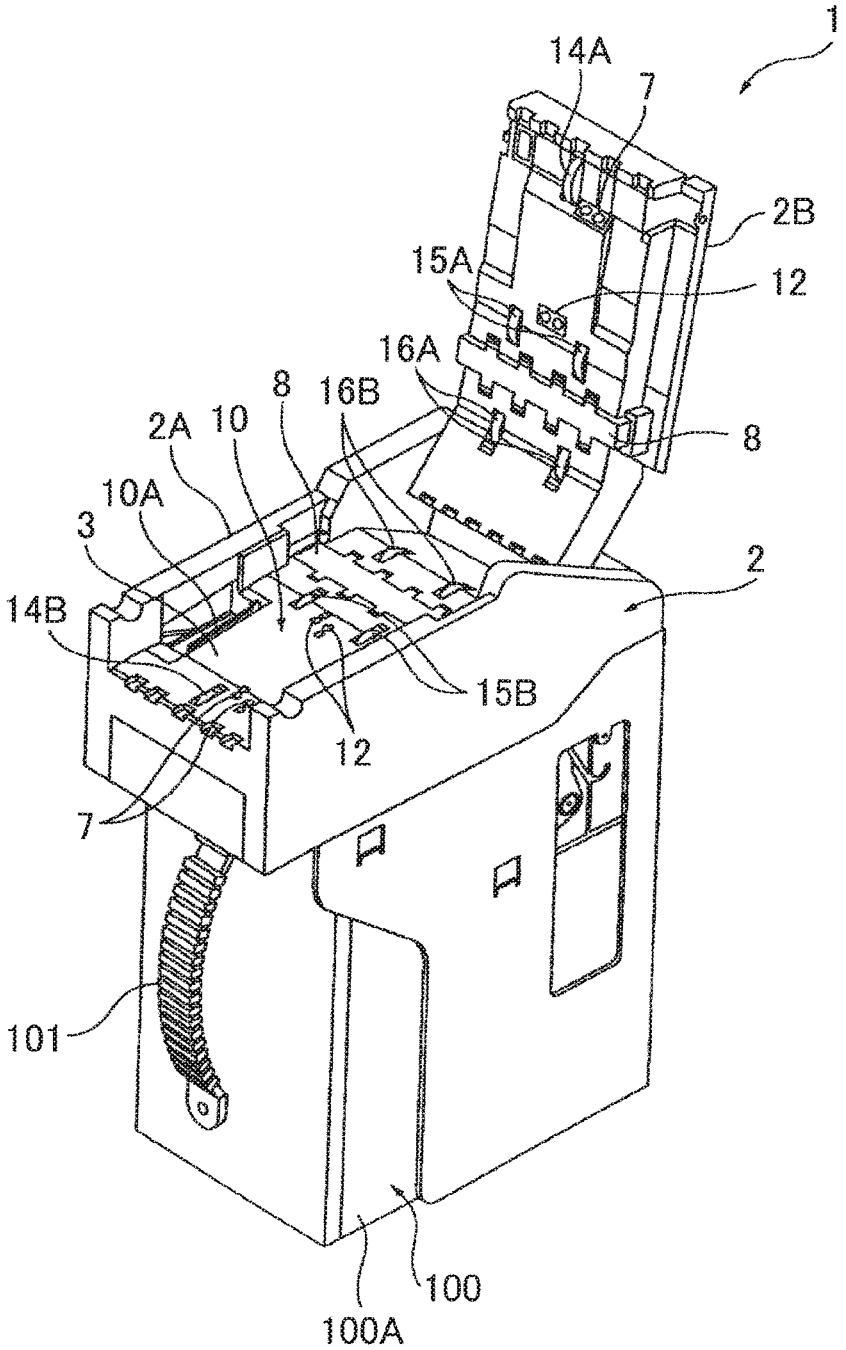
FIG. 4 is a perspective view showing a state in which a door is open with respect to a main body frame of a device main body in the banknote processing device.

As shown in FIG. 4, the following members are provided inside the device main body 2: a banknote conveyance mechanism 6 by which banknotes are conveyed; an insertion detection sensor 7 configured to detect banknotes inserted into the banknote insertion slot 5; a banknote reading sensor 8 provided downstream of the insertion detection sensor 7 to read information on each banknote being conveyed, as a reader unit; a skew correction mechanism 10 configured to precisely position each banknote with respect to the banknote reading sensor 8 and convey the banknote; and a movable piece passing detection sensor 12 configured to detect that a banknote passes through a pair of left and right movable pieces 10A constituting the skew correction mechanism 10.

Figure 5:
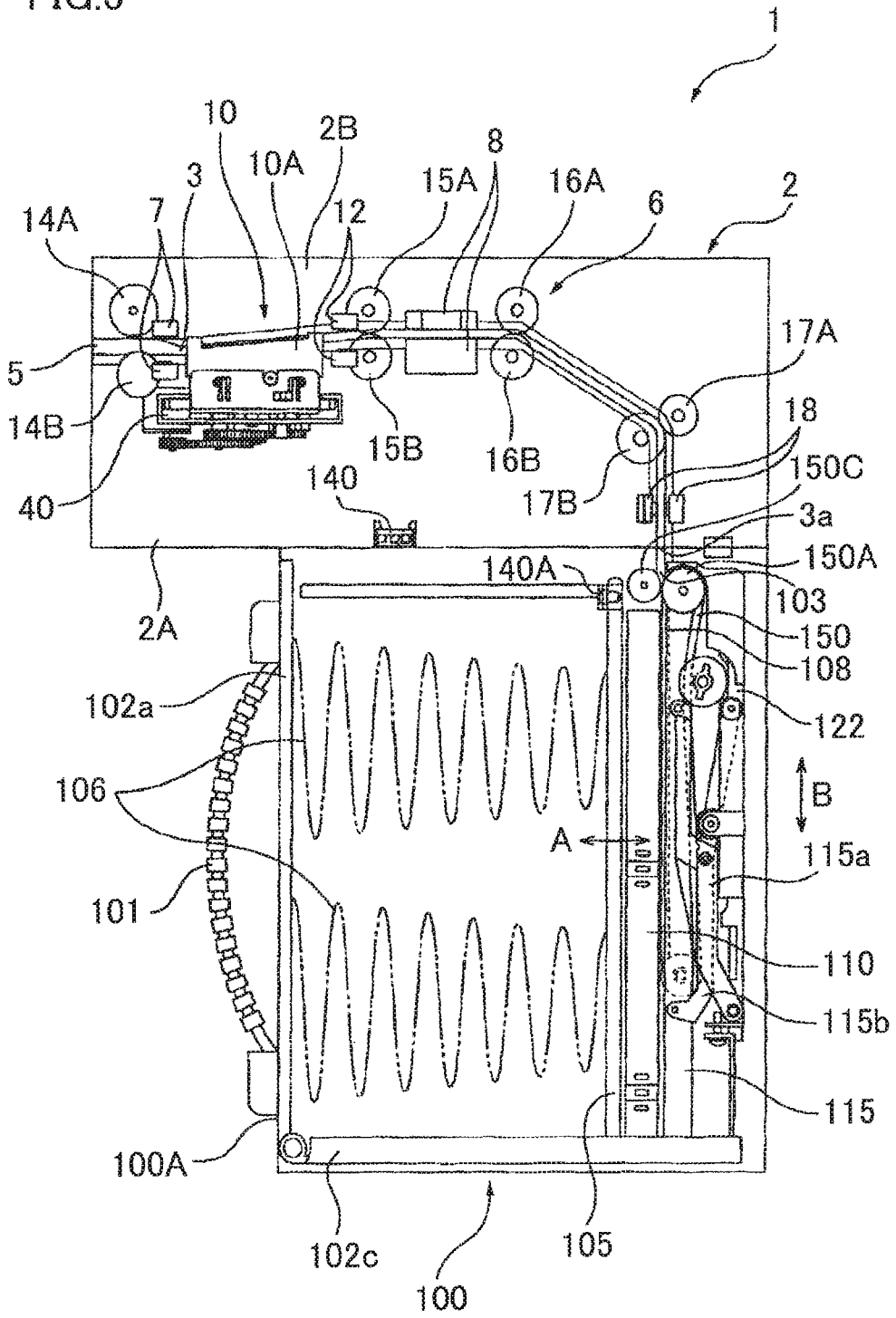
FIG. 5 is a right side view which schematically shows a conveyance path of a banknote inserted through an insertion slot in the banknote processing device.

As shown in FIG. 4 and FIG. 5, the banknote conveyance path 3 extends toward the inner side from the banknote insertion slot 5, is bended obliquely downward on the rear side, and is further bended to be parallel to the vertical direction. The banknote conveyance mechanism 6 allows banknotes having been inserted through the banknote insertion slot 5 to be conveyed along the insertion direction, and allows banknotes being inserted to be sent back toward the banknote insertion slot 5. This banknote conveyance mechanism 6 includes a later-described banknote conveyance motor 14 (see FIG. 7) provided in the device main body 2 and conveyance roller pairs 14A, 14B, 15A, 15B, 16A, 16B, 17A, and 17B which are rotationally driven by the motor and are provided on the banknote conveyance path 3 along the banknote conveyance direction, at predetermined intervals.

When the insertion of a banknote is detected by the insertion detection sensor 7, the upper conveyance roller 14A is driven toward the lower conveyance roller 14B, with the result that the inserted banknote is sandwiched. When the skew correction mechanism 10 performs a process (skew correction process) of eliminating the inclination of an inserted banknote and positioning the banknote with respect to the banknote reading sensor 8, the upper conveyance roller 14A is separated from the lower conveyance roller 14B so that no load is placed on the banknote. After the skew correction process, the upper conveyance roller 14A is driven toward the lower conveyance roller 14B again, and hence the banknote is sandwiched. The skew correction mechanism 10 is provided with a pair of left and right movable pieces 10A (only one of them is illustrated) for skew correction. The skew correction process is performed as a motor 40 for a skew driving mechanism is driven, and the banknote is conveyed in the insertion direction as the conveyance roller pairs 15A, 15B, 16A, 16B, 17A, and 17B are driven.

The insertion detection sensor 7 generates a detection signal when detecting a banknote inserted into the banknote insertion slot 5. In the present embodiment, the insertion detection sensor 7 is provided between a conveyance roller pair (14A and 14B) and the skew correction mechanism 10. While the insertion detection sensor 7 is an optical sensor such as a retro-reflective photo sensor, the insertion detection sensor 7 may be constituted by a mechanical sensor.

The movable piece passing detection sensor 12 generates a detection signal when detecting that the leading end of a banknote passes through the pair of left and right movable pieces 10A constituting the skew correction mechanism 10, and is provided upstream of the banknote reading sensor 8. This movable piece passing detection sensor 12 is also constituted by an optical sensor or a mechanical sensor, in the same manner as the insertion detection sensor 7.

The banknote reading sensor 8 reads banknote information from banknotes conveyed after skew correction (accurate positioning) has been done thereto by the skew correction mechanism 10, and determines whether each banknote is valid. To be more specific, for example, a line sensor is provided to read information from a banknote by irradiating light to the both sides of the conveyed banknote and detecting transmitted light and reflected light by a photodetector. The light signal read by the line sensor is subjected to photoelectric conversion, and compared with data of valid banknotes stored in advance. In this way, the validity of conveyed banknotes is identified.

In addition to the above, there are a discharge detection sensor 18 which is configured to detect that a banknote is discharged to the banknote accommodation unit 100, a magnetic sensor 140 which is configured to detect whether the number of banknotes accommodated and stacked in the banknote accommodation unit 100 reaches a predetermined number based on the thickness, and a control circuit board 200A by which members such as the banknote conveyance mechanism 6, the banknote reading sensor 8, and the skew correction mechanism 10 are controlled. The control circuit board 200A will be described later. In addition to the above, the discharge detection sensor 18 detects the rear end of a passing banknote to find that the banknote is discharged to the banknote accommodation unit 100. The discharge detection sensor 18 is provided immediately upstream of a receiving slot 103 of the banknote accommodation unit 100, on the downstream side of the banknote conveyance path 3. This discharge detection sensor 18 is also constituted by an optical sensor or a mechanical sensor, in the same manner as the insertion detection sensor described above. Each time the discharge detection sensor 18 detects the discharge of a banknote to the banknote accommodation unit 100, the banknote processing device 1 acquires the accumulated number from the RFID tag 104 by using the reader-writer 142, and updates the accumulated number stored in the RFID tag 104 by adding 1 to the accumulated number.

In this way, the control circuit board 200A updates the accumulated number information stored in the RFID tag 104 by using the reader-writer 142, each time the discharge detection sensor 18 detects a banknote. Furthermore, the control circuit board 200A stores banknote information in the RFID tag 104 each time the banknote reading sensor 8 detects a banknote.

The main body frame 100A constituting the banknote accommodation unit 100 is substantially rectangular parallelepiped in shape. Inside a front wall 102*a* of the main body frame 100A, one end of a biasing spring 106 is attached. At the other end, a placement plate 105 where banknotes sent through the receiving slot 103 are stacked one by one is provided. The placement plate 105 is biased toward a pressing plate 115 by the biasing spring 106. In this connection, a later-described pressing plate detection sensor 23 (see FIG. 7) is provided to be able to detect the position of the pressing plate 115 which presses banknotes toward the placement plate 105 in the banknote accommodation unit 100.

To be more specific, the pressing plate 115 is provided with pairs of link components 115*a* and 115*b*. Each pair of the link components 115*a* and 115*b* is rotatably supported by the pressing plate 115 at the both ends. The link components 115*a* and 115*b* forming each pair are connected to form an X shape, and the end portions of these link components 115*a* and 115*b*, which oppose each other in the vertical direction (indicated by an arrow B), are rotatably supported by a movable member 122 which is arranged to be movable in the vertical direction (indicated by the arrow B). With this arrangement, the pressing plate 115 is able to reciprocate in the direction indicated by an arrow A in the main body frame 100A.

In the frame 2A of the device main body 2, the magnetic sensor 140 is provided to detect that a predetermined number of banknotes are placed on the placement plate 105. As described above, the magnetic sensor 140 is mounted on the circuit board 141 of the plate 2F which is provided between the frame 2A and the stand 2D which constitute the device main body 2. A magnet 140A which applies a magnetic field to the magnetic sensor 140 is fixed to a central portion of the back surface of the placement plate 105 of the banknote accommodation unit 100. The magnet 140A therefore approaches the magnetic sensor 140 as the thickness of the banknotes pressed by the placement plate 105 increases, and hence the magnetic force detected by the magnetic sensor 140 increases. Based on the magnetic force detected by the magnetic sensor 140, the banknote processing device 1 determines the number of banknotes accommodated in the banknote accommodation unit 100. When the magnetic sensor 140 no longer detects the magnetic force of the magnet 140A, the banknote processing device 1 determines that the banknote accommodation unit 100 has been detached from the device main body 2.

The following will specifically describe the mechanical structure of the PTS terminal 700 of the present embodiment.

Figure 6:
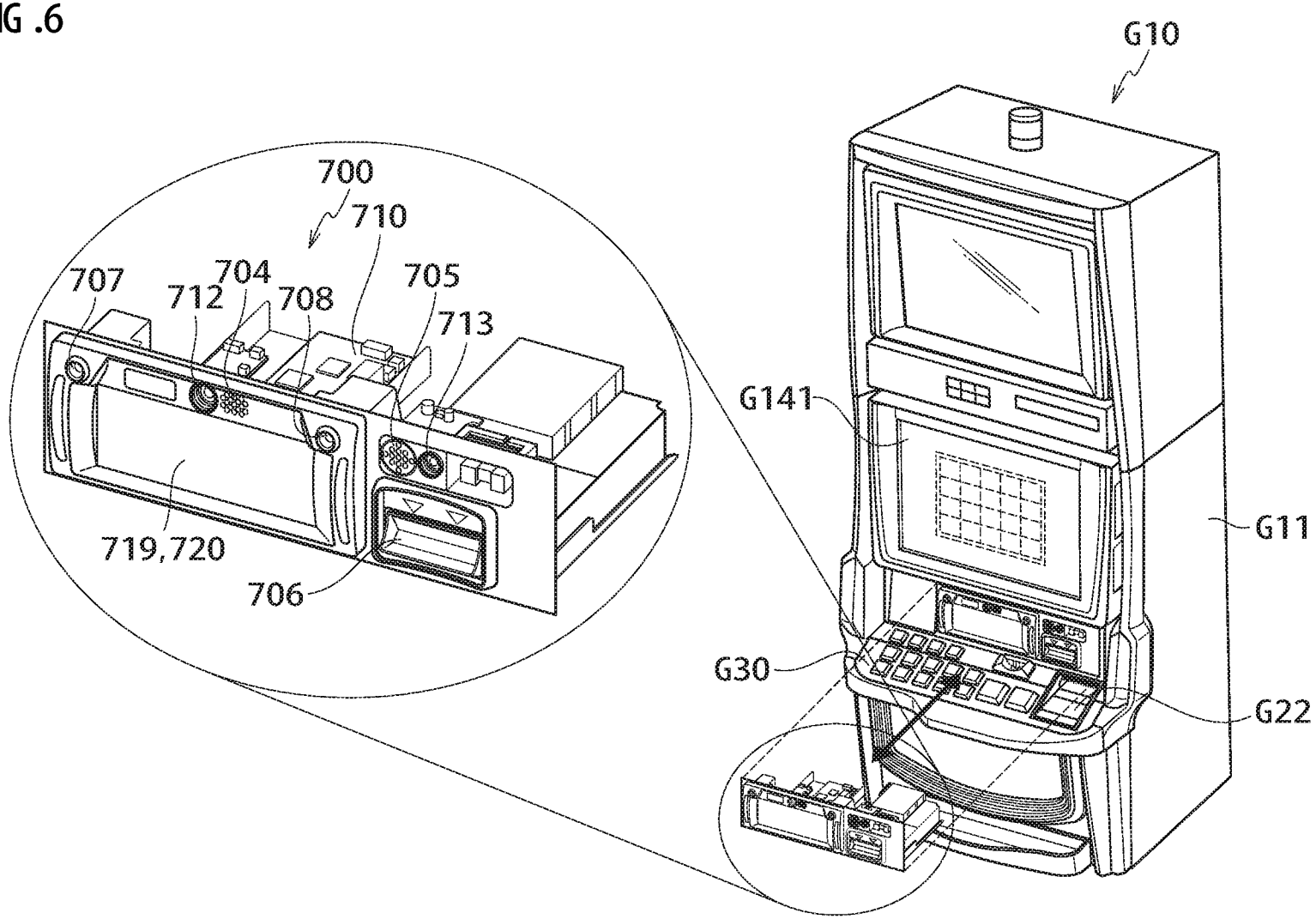
FIG. 6 is an enlarged perspective view of a PTS terminal.

As shown in FIG. 6, the PTS terminal 700 is provided in the slot machine G10 and between a game image display panel G141 which displays game images and a control panel G30 on which members such as buttons for controlling a game and the above-described bill entry G22 are provided. The PTS terminal 700 includes an LCD 719, a touch panel 720, human detection cameras 712 and 713, microphones 704 and 705, speakers 707 and 708, a card insertion slot 706, and a smart interface board 710.

The LCD 719 displays an effect image used for an effect in a game, information displayed when there is a payout as a game result, etc. The touch panel 720 is provided on the LCD 719 to cause the PTS terminal 700 to function as an input device capable of receiving input from the outside. The human detection cameras 712 and 713 make it possible to detect the presence of a player by a camera function. The microphones 704 and 705 are used for allowing a player to participate in a game through input of player's voice and for authenticating a player by voice recognition. The speakers 707 and 708 perform effects in a game by sound and output various types of notification sound. The card insertion slot 706 has a mechanism which allows an IC card such as a member card of a player of a game to be inserted or removed. The smart interface board 710 is connected to the above-described components and is a control board controlling the components, and functions as a mediation-device-side transceiver unit which controls sending and receiving of signals to and from the outside.

The following will describe an electrical configuration of the banknote processing system 1000 of the present embodiment.

Figure 7:
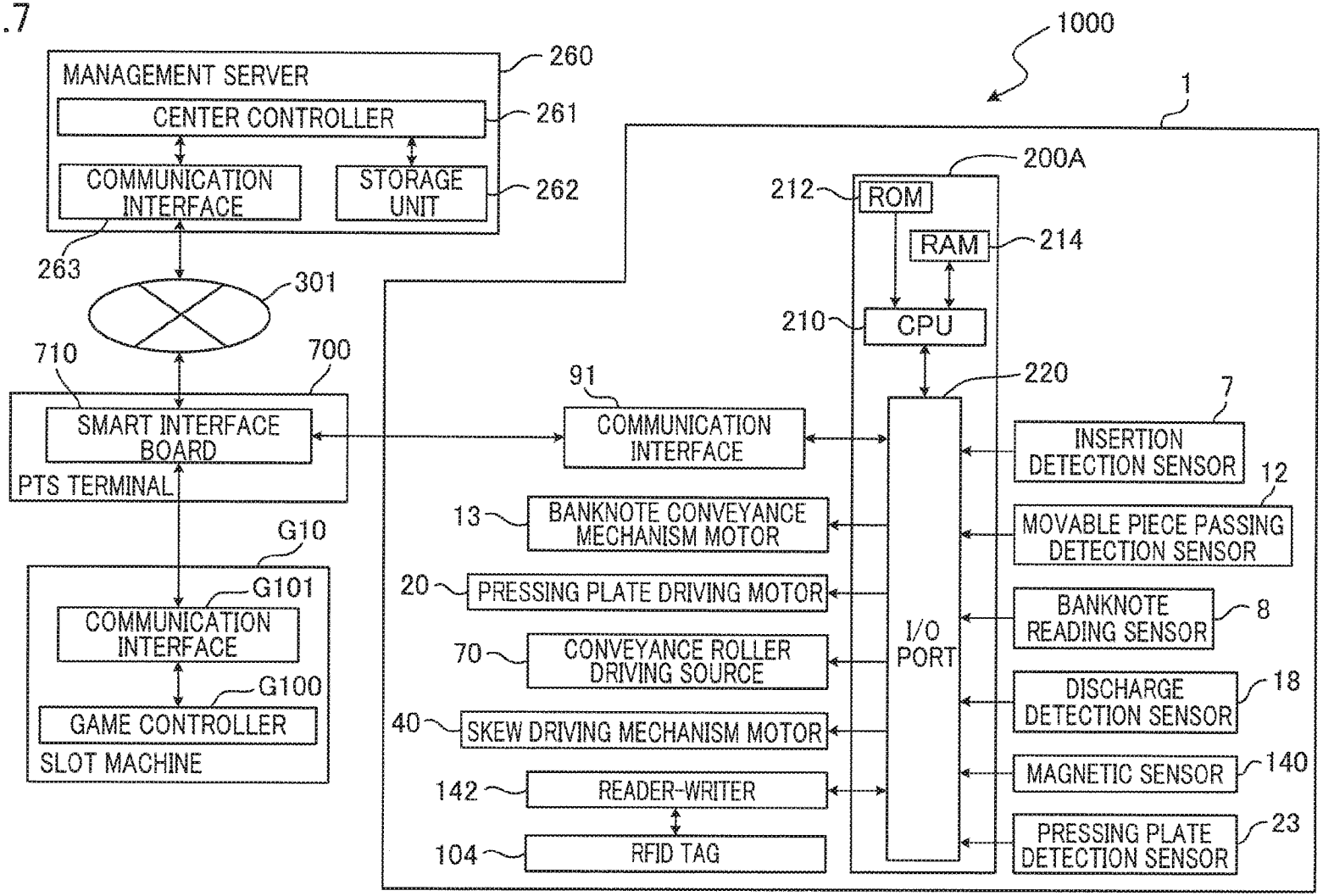
FIG. 7 is a block diagram of the electrical configuration of a banknote processing system 1000.

To begin with, the electrical configuration of the banknote processing system 1000 will be described with reference to the block diagram in FIG. 7. As shown in FIG. 7, in the banknote processing system 1000, the banknote processing device 1 and the slot machine G10 are connected to the PTS terminal 700, and the PTS terminal 700 is connected to the management server 260 through the communication line 301.

To be more specific, the banknote processing device 1 includes a control circuit board 200A configured to control operations of the above-described driving devices. The control circuit board 200A has thereon a CPU (Central Processing Unit) 210, a ROM (Read Only Memory) 212, a RAM (Random Access Memory) 214, and an I/O port 220.

The ROM 212 stores: programs such as an actuation program for driving devices such as a banknote conveyance mechanism motor 13 configured to drive the above-described banknote conveyance mechanism 6, a pressing plate driving motor 20 configured to drive the above-described pressing plate 115, a conveyance roller driving source 70 configured to drive the conveyance roller 14A to be in contact with or separated from the conveyance roller 14B, and a skew driving mechanism motor 40 configured to drive the skew driving mechanism 10, and a validity determination program for validating banknotes read by the banknote reading sensor 8; and permanent data. The CPU 210 controls the driving devices by generating a control signal based on a program stored in the ROM 212 and inputting and outputting signals between the above-described driving devices through the I/O port 220. The ROM 212 further stores reference data used for determining the validity of banknotes, e.g., sets of data acquired from the entire print region of a valid banknote (e.g., data regarding light and shade and data regarding transmitted light and reflected light when infrared light is applied to a banknote). The RAM 214 stores data and a program used in operation of the CPU 210. The RAM 214 further stores information such as accumulated number information stored in the RFID tag 104, banknote information read from banknotes, and identification information by which the attached banknote accommodation unit 100 is identified. The identification information by which the banknote accommodation unit 100 is identified is stored in the RFID tag 104 of the banknote accommodation unit 100 in advance, and is stored in the RAM 214 when the banknote accommodation unit 100 is attached.

The CPU 210 receives, through the I/O port 220, detection signals from sensors such as the insertion detection sensor 7, the movable piece passing detection sensor 12, the discharge detection sensor 18, the magnetic sensor 140, and the pressing plate detection sensor 23 detecting the position of the pressing plate 115. Based on these detection signals, the drive control of the driving devices is performed.

The CPU 210 is connected to a banknote reading sensor (e.g., line sensor) 8 constituting the above-described banknote reading sensor 8 through the I/O port 220. data read from a banknote by the banknote reading sensor 8 is compared with the reference data stored in the ROM 212, and a verification process of verifying the banknote is executed.

The CPU 210 sends, through the I/O port 220, banknote information regarding a banknote which is determined as a valid banknote to the reader-writer 142. To put it differently, the CPU 210 compares data of a banknote read by the banknote reading sensor 8 with the reference data stored in a reference data storage unit 216. When the verification process of verifying the banknote is executed and the banknote is determined as a valid banknote, the CPU 210 activates the reader-writer 142 to write the information of the valid banknote in the RFID tag 104 in the banknote accommodation unit 100.

In this case, in addition to the banknote information (e.g., monetary value information) of the accommodated banknote, time information indicating the time of insertion of the banknote and unique ID information of the device main body 2 may be stored in the RFID tag 104, in association with the banknote information. To be more specific, for example, when the banknote accommodation unit 100 is attached to the device main body 2, the unique ID information assigned to the device main body 2 of the banknote processing device 1 in advance is written into a storage unit 104*b* of the RFID tag 104 to associate the device main body 2 with the banknote accommodation unit 100.

The I/O port 220 is connected to a communication interface 91. The communication interface 91 is connected to the smart interface board 710 of the PTS terminal 700 to be able to send data to and receive data from the PTS terminal 700. The banknote processing device 1 transmits, through the communication interface 91, banknote information read from a banknote by the banknote reading sensor 8 and accumulated number information updated by the reader-writer 142 each time a banknote is accommodated to the PTS terminal 700. As such, in the banknote processing device 1, a function as a control unit which updates the accumulated number stored in the RFID tag 104 each time a banknote is accommodated in the banknote accommodation unit 100 is realized by the control circuit board 200A, the reader-writer 142, etc. Furthermore, in the banknote processing device 1, a function as an accumulated number signal transmitter which transmits an accumulated number signal indicating the updated accumulated number is realized by the control circuit board 200A, the communication interface 91, etc. Furthermore, in the banknote processing device 1, a function as a paper stock information transmitter which transmits a banknote information signal indicating banknote information to the PTS terminal 700 is realized by the control circuit board 200A, the communication interface 91, etc.

The slot machine G10 includes the game controller G100 which controls the control panel G30 and the game image display panel G141 described above and runs a game. Although not illustrated, the game controller G100 includes a CPU, a ROM, a RAM, and an I/O port to which members such as the control panel G30 and the game image display panel G141 are connected. The game controller G100 is connected to a communication interface G101 to be able to send data to and receive data from the PTS terminal 700. Through the communication interface G101, the slot machine G10 sends a game result and game information such as the content of a bet on a game to the PTS terminal 700.

In the slot machine G10, when the game controller G100 receives banknote information from the banknote processing device 1 through the PTS terminal 700, based on monetary value information in the banknote information, the game controller G100 executes a process related to a game such as addition of a credit equivalent to the monetary value indicated by the monetary value information to a credit owned by the player. The game controller G100 determines the content of the bet based on an input to the control panel G30 by the player, subtracts a credit indicated by the content of the bet from the owned credit, and starts the game based on the content of the bet.

The PTS terminal 700 includes the smart interface board 710 which controls the LCD 719, the touch panel 720, the human detection cameras 712 and 713, the microphones 704 and 705, and the speakers 707 and 708 described above and controls sending and receiving of signals to and from the outside. Although not illustrated, the smart interface board 710 includes a CPU, a GPU, a ROM, a RAM, and a communication interface by which communications under various standards with the outside are realized. Non-limiting examples of the communication standards supported by the smart interface board 710 include RS232C, RS485, optical isolation, and USB. The smart interface board 710 has a function as an Ethernet (registered trademark) controller and is arranged to be able to communicate with the management server 260 through the communication line 301.

In the PTS terminal 700, the smart interface board 710 has a function of sending accumulated number information to the management server 260 when receiving the accumulated number information from the banknote processing device 1. Furthermore, the smart interface board 710 has a function of sending banknote information to the slot machine G10 when receiving the banknote information from the banknote processing device 1. Furthermore, the smart interface board 710 has a function of sending game information to the management server 260 when receiving the game information from the slot machine G10.

The management server 260 is a computer and includes members such as a center controller 261, a storage unit 262 storing information supplied from the PTS terminal 700, etc., and a communication interface 263 by which sending and receiving of signals to and from the outside is realized. Although not illustrated, the center controller 261 includes a CPU, a ROM, a RAM, and an I/O port to which members such as the storage unit 262 and the communication interface 263 are connected. The storage unit 262 functions as a setting information storage unit which stores the maximum number of banknotes stored in the banknote accommodation unit 100 of the banknote processing device 1, which is set in advance. The center controller 261 controls members connected thereto such as the storage unit 262 and the communication interface 263, and when receiving an accumulated number signal from the PTS terminal 700, the center controller 261 functions as a detection unit which compares the accumulated number indicated by the accumulated number signal with the maximum number and determines whether the number of banknotes has reached the limitation number set to the banknote accommodation unit 100.

Figure 8:
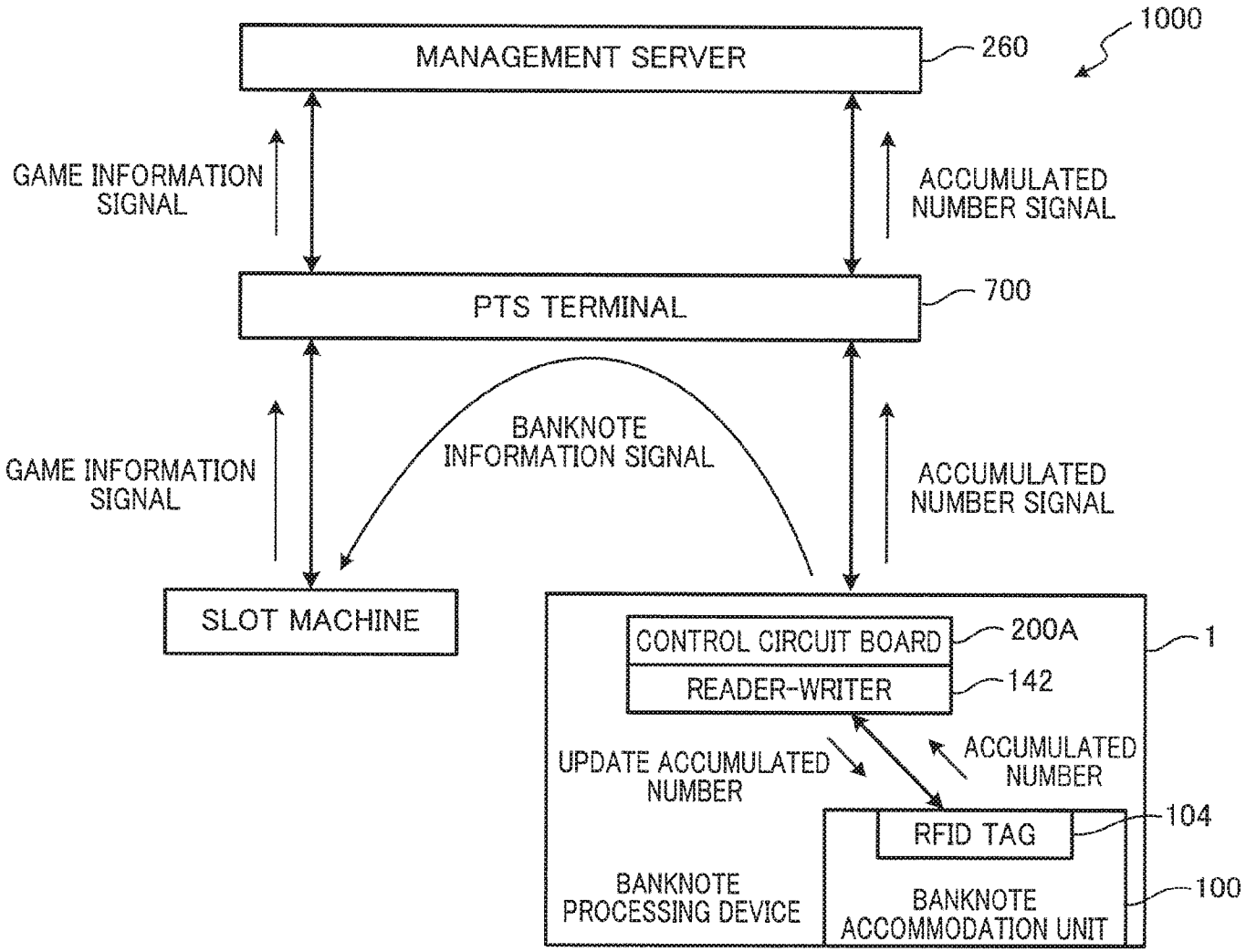
FIG. 8 is a explanatory diagram of communications and signals in the banknote processing system 1000.

The following will describe communications performed by the banknote processing system 1000 and signals transmitted in the communications, with reference to FIG. 8.

As described above, mainly three signals are transmitted in the banknote processing system 1000. As shown in FIG. 8, the three signals are the accumulated number signal, the banknote information signal, and the game information signal.

The accumulated number signal is a signal transmitted from the banknote processing device 1 to the management server 260 through the PTS terminal 700. The accumulated number signal indicates information based on the accumulated number stored in the RFID tag 104 of the banknote accommodation unit 100. The accumulated number stored in the RFID tag 104 is updated and acquired by the reader-writer 142 which is controlled by the CPU 210 of the control circuit board 200A.

To be more specific, in addition to the accumulated number, the RFID tag 104 stores information such as an identification number by which the banknote accommodation unit 100 is identified, an identification number by which the banknote processing device 1 to which the banknote accommodation unit 100 is attached is identified, and identification number by which the slot machine G10 provided in the banknote processing device 1 is identified. The CPU 210 of the control circuit board 200A generates an accumulated number signal based on these sets of information and sends the signal to the PTS terminal 700. When the banknote accommodation unit 100 accommodates banknotes in plural accommodation stages in accordance with the types of the banknotes, the accumulated number signal includes information of an accumulated number associated with an identifier by which each accommodation stage is identified.

The banknote information signal is a signal transmitted from the banknote processing device 1 to the slot machine G10 through the PTS terminal 700. As described above, the banknote information signal is generated based on banknote information read from a banknote by the banknote reading sensor 8 (see FIG. 7). The banknote information is mainly information of a monetary value of a banknote.

The game information signal is a signal transmitted from the slot machine G10 to the management server 260 through the PTS terminal 700. The game information signal is generated based on each set of information generated in accordance with the progress of a game run by the slot machine G10, and this signal is transmitted to the management server 260.

For example, when the slot machine G10 starts a single execution of a slot game, a game information signal indicating the start of the game is transmitted. This game information signal includes information such as identification information by which the slot machine G10 is identified, information indicating the start of the game, information indicating a credit betted on the game, and information indicating the unit (denomination) of the credit.

When the slot machine G10 finishes the single execution of the slot game, a game information signal indicating the finish of the game is transmitted. This game information signal includes information such as identification information by which the slot machine G10 is identified, information indicating the finish of the game, and information indicating a payout credit based on a game result.

Although not illustrated, when the banknote accommodation unit 100 (stacker) is replaced in the banknote processing device 1, a stacker replacement signal is transmitted from the banknote processing device 1 to the management server 260 through the PTS terminal 700. The stacker replacement signal includes identification information by which a banknote accommodation unit 100 before replacement is identified, identification information by which a banknote accommodation unit 100 after replacement is identified, identification information by which the slot machine G10 is identified, and identification information by which the banknote processing device 1 is identified.

The following will describe a data table stored in the storage unit 262 of the management server 260 in the present embodiment.

To begin with, a maximum number table stored in the storage unit 262 will be described with reference to FIG. 9.

In the maximum number table, the maximum number is associated with each type of the banknote accommodation unit 100. To be more specific, the maximum number table has a stacker type column, an accommodation stage column, a maximum number column, and an allowable number column.

The stacker type column stores a type of the banknote accommodation unit 100. The accommodation stage column stores an identifier for identifying each accommodation stage when the banknote accommodation unit 100 has plural accommodation stages. The maximum number column stores the maximum number which is set for each type of the banknote accommodation unit 100. When the banknote accommodation unit 100 has plural accommodation stages, the maximum number is set for each accommodation stage. The allowable number column stores the maximally allowable number which is set for each type of the banknote accommodation unit 100. When the banknote accommodation unit 100 has plural accommodation stages, the maximally allowable number is set for each accommodation stage.

For example, a banknote accommodation unit 100 denoted as A is arranged to accommodate received banknotes in the same space without grouping them by type. The maximum number of banknotes accommodated is 490, and the allowable number of banknotes is 500. A banknote accommodation unit 100 denoted as B is arranged to accommodate banknotes in four accommodation stages (accommodation stages B1, B2, B3, and B4) in accordance with the type of banknote. The four accommodation stages have different spaces, respectively. The maximum numbers of banknotes accommodated in the respective accommodation stages are 195, 95, 95, and 95. The allowable numbers of banknotes accommodated in the respective accommodation stages are 200, 100, 100, and 100. A banknote accommodation unit 100 denoted as C is arranged to accommodate received banknotes in the same space without grouping them by type. The maximum number of banknotes accommodated is 980, and the allowable number of banknotes is 1000.

When the center controller 261 of the management server 260 determines that the number of banknotes accommodated in the banknote accommodation unit 100 has reached the maximum number, the center controller 261 performs a warning process of prompting the administrator to replace the banknote accommodation unit 100, by means of a warning, etc. When the center controller 261 of the management server 260 determines that the number of banknotes accommodated in the banknote accommodation unit 100 has reached the allowable number, the center controller 261 performs a stop process of, for example, stopping the acceptance of banknotes by sending a signal to the slot machine G10 and/or the banknote processing device 1 through the PTS terminal 700.

The following will describe a banknote container management table stored in the storage unit 262 with reference to FIG. 10.

In the banknote container management table, information indicating the current state is associated with each of all banknote accommodation units 100 which are managed. To be more specific, the banknote container management table has a stacker identification information column, a slot machine identification number column, a banknote processing device identification number column, a stacker type column, an accommodation stage column, an accumulated number column, and a status column.

The stacker identification number column stores a unique number for identifying each of all banknote accommodation units 100 which are managed. The slot machine identification number column stores a unique number for identifying each slot machine G10 in which the banknote processing device 1 to which the banknote accommodation unit 100 is attached is stored. The banknote processing device identification number column stores a unique number for identifying each banknote processing device 1 to which the banknote accommodation unit 100 is attached. The stacker type column indicates the type of the banknote accommodation unit 100 specified by the stacker identification number, and corresponds to a stacker type in the maximum number table (see FIG. 8). The accommodation stage column stores an identifier for identifying each accommodation stage, when the banknote accommodation unit 100 accommodates banknotes in plural accommodation stages in accordance with the type of banknote. The accommodation stage column corresponds to the accommodation stage column in the maximum number table (see FIG. 9). The accumulated number column stores the number of banknotes currently stored in the banknote accommodation unit 100. The status column stores a state of banknotes stored in the banknote accommodation unit 100.

The center controller 261 of the management server 260 updates the number in the accumulated number column corresponding to the banknote processing device identification number indicating the banknote processing device 1 which is the sender, each time the center controller 261 receives the accumulated number from the banknote processing device 1 through the PTS terminal 700. The center controller 261 then acquires the maximum number and the allowable number with reference to the maximum number table (FIG. 8) based on the stacker type corresponding to the banknote processing device identification number, and compares them with the updated accumulated number. When the accumulated number is smaller than the maximum number, the center controller 261 sets the status at "in progress". When the accumulated number is equal to or larger than the maximum number but is smaller than the allowable number, the center controller 261 sets the status at "warning" and executes the warning process. When the accumulated number is equal to or larger than the allowable number, the center controller 261 sets the status at "stopped" and executes the stop process. When a signal indicating that the banknote accommodation unit 100 has been detached is sent from the banknote processing device 1 through the PTS terminal 700, the center controller 261 sets the status as "storing". The processes executed by the center controller 261 will be detailed later.

Figure 11:
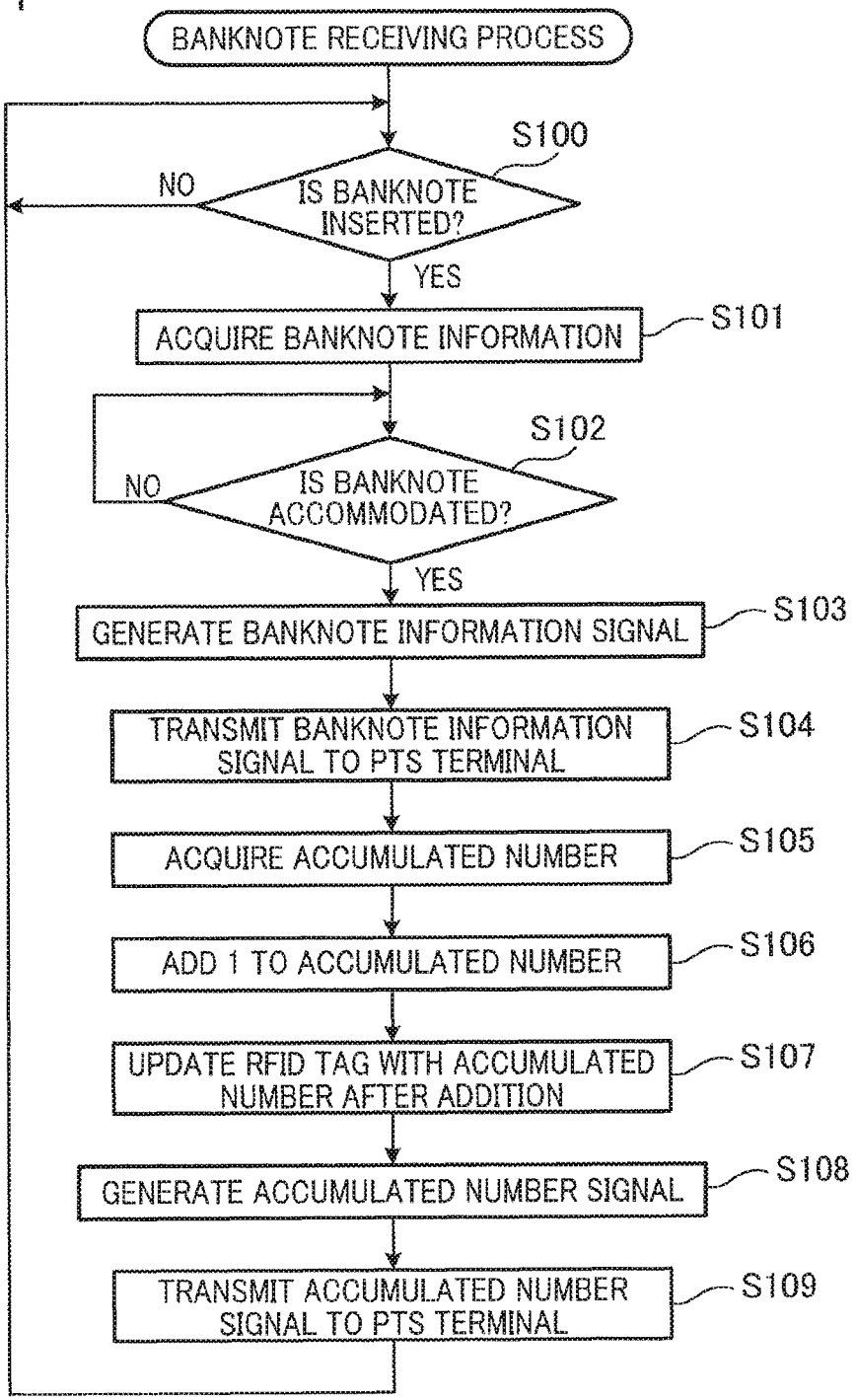
FIG. 11 is a flowchart of a banknote receiving process executed by the banknote processing device.

The following will describe a flowchart of a banknote receiving process executed by the CPU 210 of the control circuit board 200A when the banknote processing device 1 receives a valid banknote, with reference to FIG. 11. It should be noted that descriptions of conveyance of the banknote are omitted.

To begin with, the CPU 210 determines whether a valid banknote is inserted (S100). When a valid banknote is not inserted (NO in S100), the CPU 210 executes the step S100 again and waits for the insertion of a valid banknote. When a valid banknote is inserted (YES in S100), the CPU 210 acquires the banknote information of the inserted banknote based on a signal from the banknote reading sensor 8 (see FIG. 4, FIG. 5, and FIG. 7) (S101).

Based on a signal from the discharge detection sensor 18 (see FIG. 5 and FIG. 7), the CPU 210 determines whether the banknote from which the banknote information has been read is accommodated in the banknote accommodation unit 100 (S102). When the banknote is not accommodated in the banknote accommodation unit 100 (NO in S102), the CPU 210 executes the step S102 again and waits for the accommodation of the banknote in the banknote accommodation unit 100. When the banknote is accommodated in the banknote accommodation unit 100 (YES in S102). the CPU 210 generates a banknote information signal based on the acquired banknote information (S103). The CPU 210 then sends the generated banknote information signal to the PTS terminal 700 (S104).

The CPU 210 then acquires the accumulated number stored in the RFID tag 104 by controlling the reader-writer 142 (S105). In this step, the CPU 210 may store the banknote information acquired in the step S101 in the RFID tag 104 by controlling the reader-writer 142. As a result, the latest banknote information is stored in the RFID tag 104. The CPU 210 then adds 1 to the acquired accumulated number and temporarily stores the number after the addition in the RAM 214 (S106).

The CPU 210 then updates the accumulated number stored in the RFID tag 104 to the accumulated number after the addition of 1, by controlling the reader-writer 142 (S107). The CPU 210 then generates an accumulated number signal based on this updated accumulated number (S108). The CPU 210 then sends the generated accumulated number signal to the PTS terminal 700 (S109) and goes back to the step S100.

Figure 12:
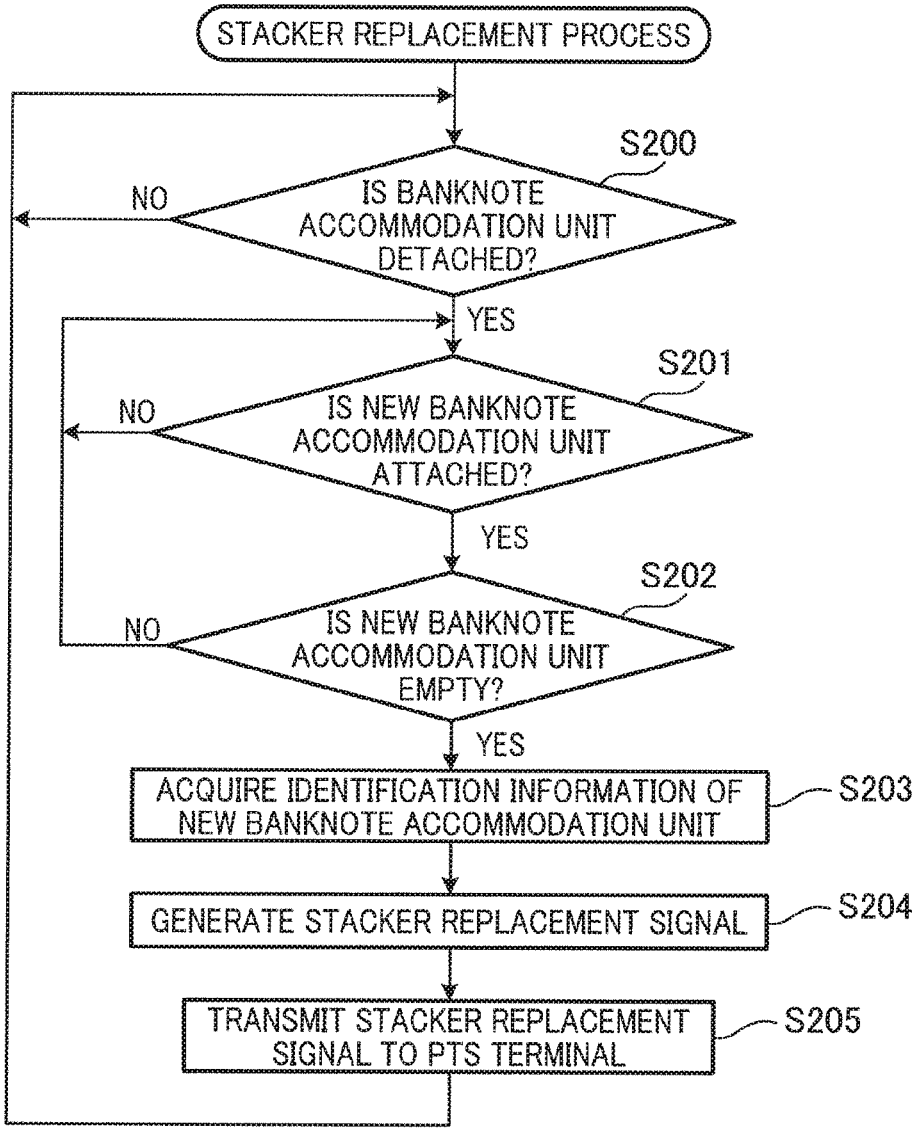
FIG. 12 is a flowchart of a stacker replacement process executed by the banknote processing device.

The following will describe a flowchart of a stacker replacement process executed by the CPU 210 of the control circuit board 200A when the banknote accommodation unit 100 is replaced in the banknote processing device 1, with reference to FIG. 12.

To begin with, the CPU 210 determines whether the banknote accommodation unit 100 is detached, based on a signal from the magnetic sensor 140 (see FIG. 5 and FIG. 7) (S200). When the banknote accommodation unit 100 has not been detached (NO in S200), the CPU 210 executes the step S200 again and waits for the detachment.

When the banknote accommodation unit 100 has been detached (YES in S200), the CPU 210 determines whether a new banknote accommodation unit 100 has been attached (S201). When a new banknote accommodation unit 100 has not been attached (NO in S201), the CPU 210 executes the step S201 again and waits for the attachment.

When a new banknote accommodation unit 100 is attached (YES in S201), the CPU 210 determines whether a banknote is accommodated in the new banknote accommodation unit 100 based on a signal from the magnetic sensor 140 (see FIG. 5 and FIG. 7) (S202). When a banknote is accommodated in the new banknote accommodation unit 100 (NO in S202), the CPU 210 goes back to the step S201.

When no banknote is accommodated in the new banknote accommodation unit 100 (YES in S202), the CPU 210 acquires the identification information of the new banknote accommodation unit 100 (S203). The CPU 210 then generates a stacker replacement signal based on the identification information of the new banknote accommodation unit 100, the identification information of the banknote accommodation unit 100 before replacement, which is stored in the RAM 214, etc. (S204). The CPU 210 then sends the generated stacker replacement signal to the PTS terminal 700 (S205) and goes back to the step S200.

Figure 13:
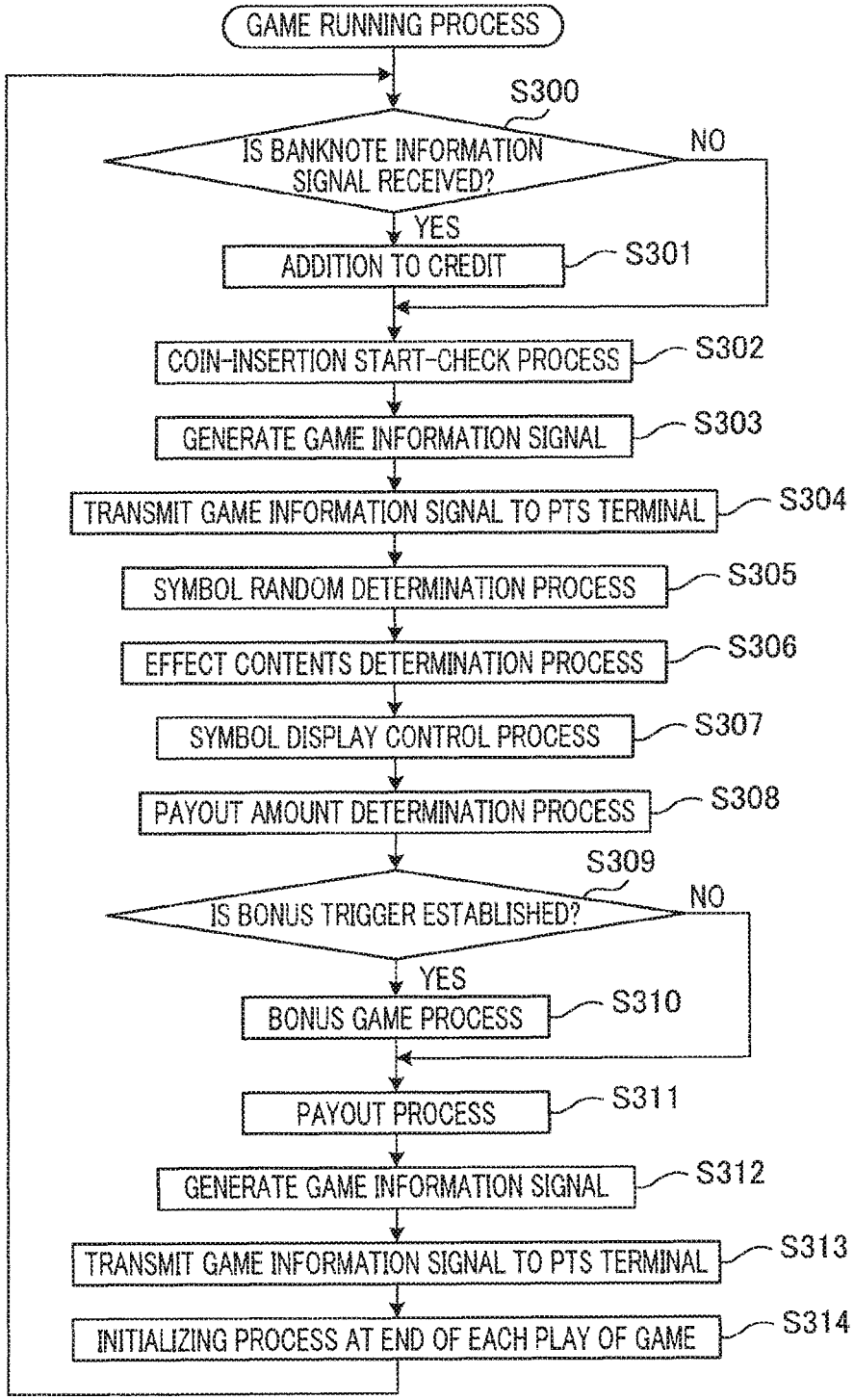
FIG. 13 is a flowchart of a game running process executed by a slot machine.

The following will describe a flowchart of the game running process executed by the game controller G100 of the slot machine G10 with reference to FIG. 13.

To begin with, the game controller G100 determines whether a banknote information signal has been supplied from the PTS terminal 700 (S300). When the banknote information signal has been supplied (YES in S300), the game controller G100 adds a credit amount based on the banknote information signal to a credit amount stored in the storage area and owned by the player (S301).

After the step S301 or when no banknote information signal is supplied (NO in S300), the game controller G100 executes a coin-insertion start-check process (S302). In this process, the control panel G30 checks inputs to the bet switch and the spin switch, etc., and a betted credit amount is subtracted from the owned credit amount. The game controller G100 then generates a game information signal based on information such as identification information by which the slot machine G10 is identified, information indicating the start of the game, information indicating a credit betted on the game, and information indicating the unit (denomination) of the credit (G303), and transmits the generated game information signal to the PTS terminal (S304).

The game controller G100 then executes a symbol random determination process (S305). In this process, to-be-stopped symbols are determined based on a random number for symbol determination. The game controller G100 then executes an effect contents determination process (S306). The game controller G100 samples an effect-use random number and randomly selects any of a plurality of predetermined effect contents.

The game controller G100 then executes a symbol display control process (S307). In this process, scroll of symbol columns on video reels or mechanical reels starts, and the to-be-stopped symbols determined in the symbol random determination process in S305 are stopped at predetermined positions. The game controller G100 then executes a payout amount determination process (S308). In this process, a payout amount is determined based on a combination of symbols displayed on a winning line.

The game controller G100 then determines whether a bonus game trigger is established (S309). When the bonus game trigger is established (YES in S309), the game controller G100 executes a bonus game process (S310).

After S310 or when it is determined in S309 that the bonus game trigger is not established (NO in S309), the game controller G100 executes a payout process (S311). The game controller G100 adds a value stored in a payout counter to a credit counter (indicating a credit amount owned by the player).

The game controller G100 then generates a game information signal based on information such as identification information by which the slot machine G10 is identified, information indicating the finish of the game, and information indicating a payout credit based on a game result (G312), and transmits the generated game information signal to the PTS terminal (S313).

The game controller G100 then executes an initializing process at the end of each play of the game (S314) and goes back to S300. This initializing process at the end of each play of the game clears data in a working area of the RAM, etc. of the game controller G100, which becomes unnecessary at the end of each play of game, e.g., a bet amount and a randomly determined symbol.

As described above, when the game controller G100 receives the banknote information signal, the slot machine 1 executes a game based on the banknote information indicated by the banknote information signal.

Figure 14:
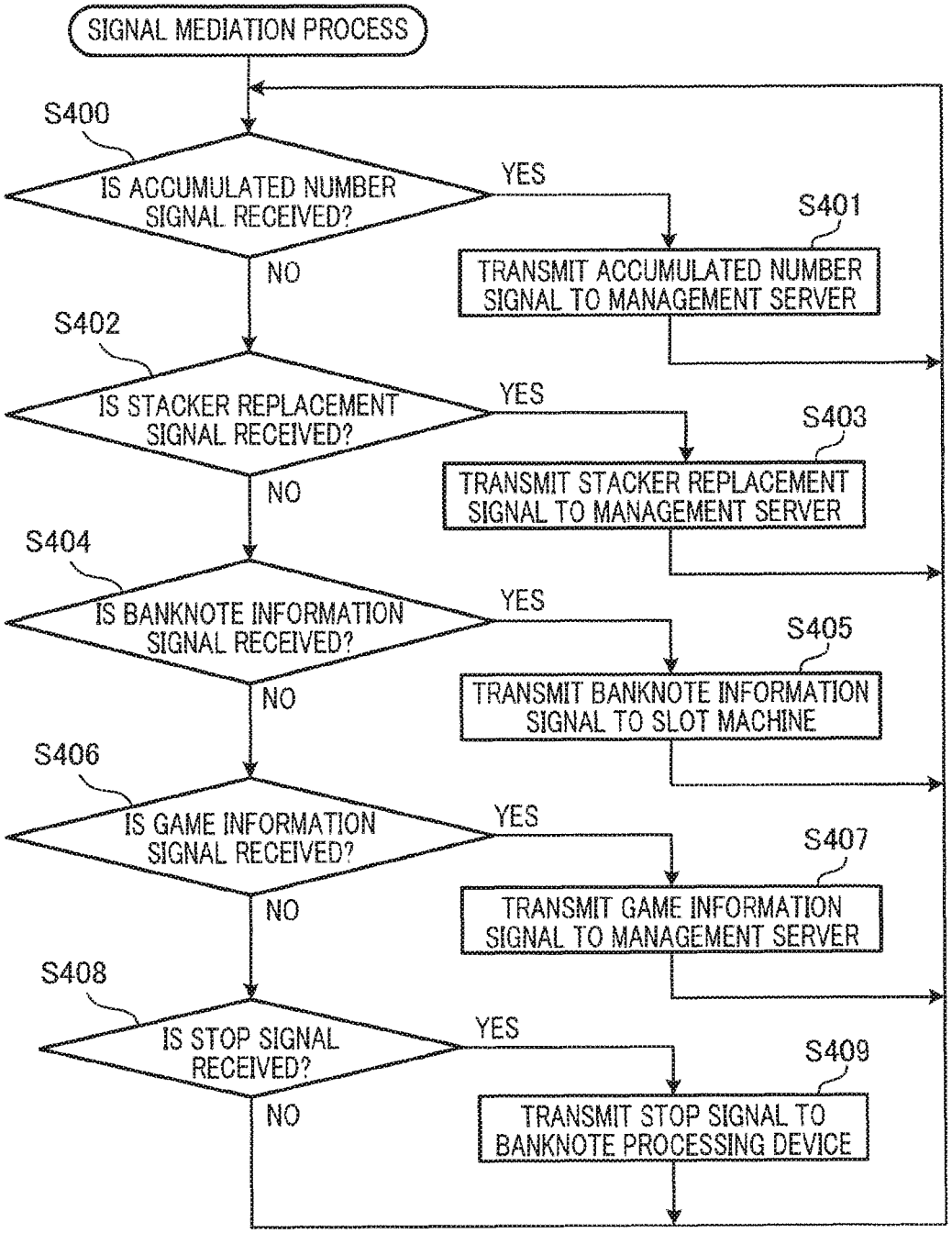
FIG. 14 is a flowchart of a signal mediation process executed by the PTS terminal.

The following will describe a flowchart of a signal mediation process executed by the smart interface board 710 of the PTS terminal 700 with reference to FIG. 14.

To begin with, the smart interface board 710 determines whether an accumulated number signal is supplied from the banknote processing device 1 (S400). When the accumulated number signal is supplied from the banknote processing device 1 (YES in S400), the smart interface board 710 transmits the accumulated number signal to the management server 260 (S401) and goes back to the step S400.

When the accumulated number signal is not supplied from the banknote processing device 1 (NO in S400), the smart interface board 710 determines whether a stacker replacement signal is supplied from the banknote processing device 1 (S402). When the stacker replacement signal is supplied from the banknote processing device 1 (YES in S402), the smart interface board 710 transmits the stacker replacement signal to the management server 260 (S403) and goes back to the step S400.

When the stacker replacement signal is not supplied from the banknote processing device 1 (NO in S402), the smart interface board 710 determines whether a banknote information signal is supplied from the banknote processing device 1 (S404). When the banknote information signal is supplied from the banknote processing device 1 (YES in S404), the smart interface board 710 transmits the banknote information signal to the slot machine G10 (S405) and goes back to the step S400.

When the banknote information signal is not supplied from the banknote processing device 1 (NO in S404), the smart interface board 710 determines whether a game information signal is supplied from the slot machine G10 (S406). When the game information signal is supplied from the slot machine G10 (YES in S406), the smart interface board 710 transmits the game information signal to the management server 260 (S407) and goes back to the step S400.

When the game information signal is not supplied from the banknote processing device 1 (NO in S406), the smart interface board 710 determines whether a stop signal is supplied from the management server 260 (S408). When the stop signal is supplied from the management server 260 (YES in S408), the smart interface board 710 transmits the stop signal to the banknote processing device 1 (S409). After the step S409 or when the stop signal is not supplied from the management server 260 (NO in S408), the smart interface board 710 goes back to the step S400. Although not illustrated, when the banknote processing device 1 receives the stop signal from the PTS terminal 700, the acceptance of banknotes by the banknote accommodation unit 100 is stopped.

As described above, when an accumulated number signal is supplied from the banknote processing device 1, the accumulated number signal is transmitted to the outside (management server 260). Furthermore, when the smart interface board 710 receives a banknote information signal, the PTS terminal 700 transmits the banknote information signal to the slot machine G10.

In the present embodiment, signal data of signals such as the accumulated number signal, the stacker replacement signal, and the game information signal received by the smart interface board 710 is generated by the CPU 210 of the banknote processing device 1 or the game controller G100 of the slot machine G10. The disclosure, however, is not limited to this arrangement. For example, these signals may be generated by the smart interface board 710.

Figure 15:
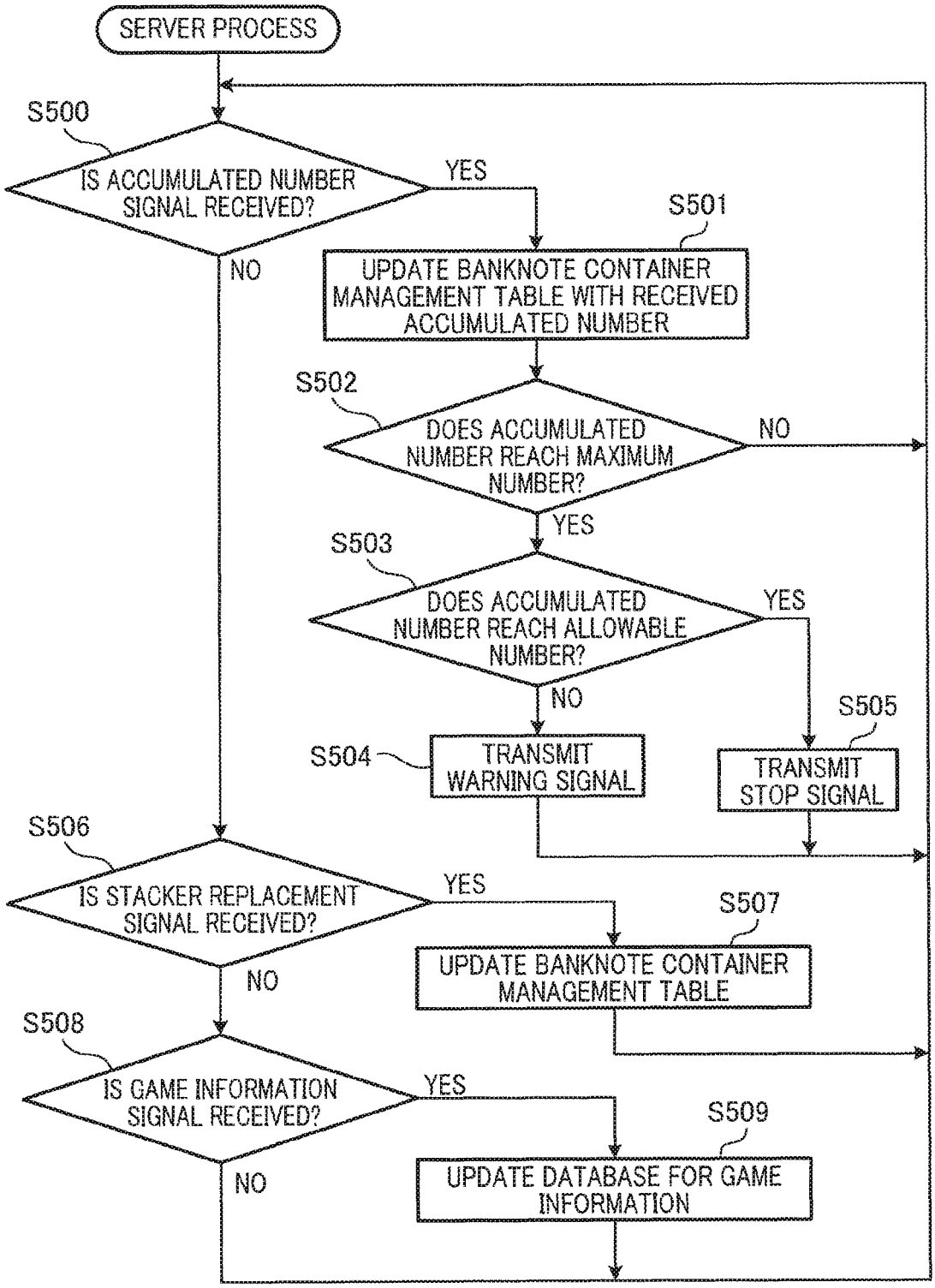
FIG. 15 is a flowchart of a server process executed by a management server.

The following will describe a flowchart of a server process executed by the center controller 261 of the management server 260 with reference to FIG. 15.

To begin with, the center controller 261 determines whether an accumulated number signal is supplied (S500). When the accumulated number signal is supplied, the center controller 261 updates the banknote container management table with the accumulated number which is based on the received accumulated number signal (S501). To be more specific, with reference to the banknote container management table (see FIG. 10), the center controller 261 searches for data which corresponds to the identification number of the banknote processing device 1 which has supplied the accumulated number signal and the stacker identification number. Then the center controller 261 updates a number which corresponds to the data and in the accumulated number column with the accumulated number based on the accumulated number signal. At this stage, whether the correspondence between the identification number of the banknote accommodation unit 100, the identification number of the slot machine G10, and the identification number of the banknote processing device 1 in the accumulated number signal is matched with the banknote container management table (see FIG. 10) may be determined.

The center controller 261 then determines whether the accumulated number based on the received accumulated number signal has reached the maximum number (S502). To be more specific, the center controller 261 refers to an item in the stacker type column corresponding to the data specified by the step S501, searches the maximum number table (see FIG. 9) for a stacker type corresponding to the item, and acquires the maximum number. The center controller 261 then compares the accumulated number with the maximum number and determines whether the accumulated number has reached the maximum number. When the accumulated number has not reached the maximum number (NO in S502), the center controller 261 goes back to the step S500.

When the accumulated number has reached the maximum number (YES in S502), the center controller 261 determines whether the accumulated number has reached the allowable number (S503). To be more specific, the center controller 261 refers to an item in the stacker type column corresponding to the data specified by the step S501, searches the maximum number table (see FIG. 9) for a stacker type corresponding to the item, and acquires the allowable number. The center controller 261 then compares the accumulated number with the allowable number and determines whether the accumulated number has reached the allowable number.

When the accumulated number has not reached the allowable number (NO in S503), the center controller 261 transmits a warning signal (S504) and goes back to the step S500. The warning signal is, for example, sent to a terminal owned by a staff member of the gaming facility where the slot machine G10 is installed, via the communication line 301. The warning signal includes information for specifying the slot machine G10 which includes the banknote processing device 1 having the banknote accommodation unit 100. This allows the staff member to go to the slot machine G10 including the banknote accommodation unit 100 in order to replace the banknote accommodation unit 100. In this process, the center controller 261 updates the status column of the banknote container management table (see FIG. 10) to "warning".

When the accumulated number has reached the allowable number in the step S503 (YES in S503), the center controller 261 transmits a stop signal to the PTS terminal 700 (S505) and goes back to the step S500. In this process, the center controller 261 updates the status column of the banknote container management table (see FIG. 10) to "stopped".

When the accumulated number signal is not received in the step S500 (NO in S500), the center controller 261 determines whether a stacker replacement signal has been received (S506). When the stacker replacement signal has been received (YES in S506), the center controller 261 updates the banknote container management table (see FIG. 10) (S507) and goes back to the step S500. To be more specific, in the step S507, with reference to the banknote container management table (see FIG. 10), the center controller 261 searches for data which corresponds to the identification number of the banknote processing device 1 which has supplied the stacker replacement signal and the stacker identification number. Items corresponding to the data in the slot machine identification number column and the banknote processing device identification number column are changed to be empty, and the status column is updated to "storing".

In the step S507, the center controller 261 searches for data corresponding to a stacker identification number of a new banknote accommodation unit 100, which is included in the stacker replacement signal. When such data is not found, data of this stacker identification number is newly added. The center controller 261 then stores, in the items corresponding to the data in the slot machine identification number column and the banknote processing device identification number column, sets of identification information included in the stacker replacement signal, i.e., identification information for identifying the slot machine G10 and identification information for identifying the banknote processing device 1. Furthermore, the center controller 261 stores 0 in the accumulated number column and updates the status column to "in progress".

When the stacker replacement signal is not received in the step S506 (NO in S506), the center controller 261 determines whether a game information signal has been received (S508). When the game information signal has been received (YES in S508), the center controller 261 updates a database (not illustrated) storing game information with information based on the acquired game information signal (S509). After the step S509 or when the game information signal has not been received in the step S508 (NO in S508), the center controller 261 goes back to the step S500.

As such, the management server 260 stores the maximum number table (see FIG. 9) which stores the maximum number set in advance, and when the center controller 261 receives an accumulated number signal from the PTS terminal 700, the management server 260 compares the accumulated number indicated by the accumulated number signal with the maximum number so as to determine whether the number of banknotes has reached the limitation number of the banknote accommodation unit 100.

While in the present embodiment the banknote processing device 1 transmits the accumulated number in the form of an accumulated number signal to the management server 260 through the PTS terminal, the disclosure is not limited to this arrangement. For example, the limitation number of the banknote accommodation unit 100 may be stored in the RFID tag 104, and the accumulated number may be compared with the limitation number in the banknote processing device 1.

In other words, a banknote processing device may include members such as: a banknote reading sensor 8 configured to read a banknote inserted into a banknote insertion slot 5; a banknote accommodation unit 100 configured to accommodate the banknote read by the banknote reading sensor 8; an RFID tag 104 which is configured to store the accumulated number of banknotes accommodated in the banknote accommodation unit 100; a CPU 210 of a control circuit board 200A which is configured to update the accumulated number stored in the RFID tag 104 each time a banknote is accommodated in the banknote accommodation unit 100; and a communication interface 91 which is configured to transmit a warning signal to a management server 260 when the accumulated number updated by the CPU 210, etc. reaches the limitation number set to the banknote accommodation unit 100.

In this way, the accumulated number of the RFID tag 104 is updated each time a banknote is stored in the accommodation unit, and a warning signal is transmitted to the management server 260 when the accumulated number reaches the limitation number set to the banknote accommodation unit 100. Because the accumulated number of banknotes accommodated in the banknote accommodation unit 100 is updated each time a banknote is accommodated and a warning signal is output based on the accumulated number, it is possible to correctly detect that the number of banknotes accommodated in the banknote accommodation unit 100 has reached the limit.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A paper stock processing system, comprising:

a paper stock processing device including an accommodation unit which accommodates a stack of individual sheets of paper stock inserted into an insertion slot;

a paper stock information storage unit configured to store an accumulated number of the individual sheets of paper stock accommodated in the accommodation unit;

a control unit configured to update the accumulated number of the individual sheets of paper stock stored in the storage unit each time an individual sheet of the paper stock is accommodated in the accommodation unit;

an accumulated number signal transmitter configured to transmit an accumulated number signal indicating the accumulated number updated by the control unit;

a mediation device; and an external apparatus, wherein the mediation device includes a mediation-device-side transceiver unit which is configured to control sending and receiving of signals to and from the external apparatus and to transmit the accumulated number signal to the external apparatus when receiving the accumulated number signal from the paper stock processing device;

wherein the external apparatus includes an external-apparatus-side receiver configured to receive a signal from the mediation device;

a setting information storage unit configured to store a maximum number which is set in advance; and a center controller configured to use the accumulated number signal from the mediation device to compare the accumulated number indicated by the accumulated number signal with the maximum number and determine whether the accumulated number of the individual sheets of paper stock has reached a limitation number set for the accommodation unit; and wherein the paper stock processing device additionally includes a magnetic sensor that is arranged to detect the size of the stack of individual sheets of paper accommodated in the accommodation unit, the magnetic sensor comprising a magnet and a magnetic field-detecting element with one of the magnet and the magnetic field-detecting element being located on the accommodation unit and the other of the magnet and the magnetic field-detecting element being located elsewhere on the paper stock processing device, the magnet and the magnetic field-detecting element being mutually arranged such that the strength of the magnetic field produced by the magnet and sensed by the magnetic field-detecting element varies as the size of the stack of individual sheets of paper accommodated in the accommodation unit varies.

2. The paper stock processing system according to claim 1, further comprising a gaming machine in which the paper stock processing device and the mediation device are provided, the paper stock processing device further including a reader unit which is provided in the gaming machine to allow the individual sheets of paper stock to be inserted into the insertion slot from outside of the gaming machine; and a paper stock information transmitter which is configured to send a paper stock information signal indicating paper stock information to the mediation device, wherein when the mediation-device-side transceiver unit receives the paper stock information signal, the mediation device transmits the paper stock information signal to the gaming machine, and wherein the gaming machine includes a game running unit which runs a game based on the paper stock information indicated by the paper stock information signal, when receiving the paper stock information signal from the external-apparatus-side receiver.

3. The paper stock processing system according to claim 1, wherein the paper stock processing system includes a plurality of paper stock processing devices, the setting information storage unit is configured to store, for each of the plurality of paper stock processing devices in the system, a maximum number which is set in advance, the external-apparatus-side receiver is configured to receive an accumulated number signal from the mediation device of each of the plurality of paper stock processing devices in the system, and the controller is configured to use the accumulated number signal from the mediation device of each of the plurality of paper stock processing devices in the system to determine whether the accumulated number of individual sheets of paper stock in a given paper stock processing device in the system has reached a corresponding maximum number.

4. The paper stock processing system according to claim 1, wherein the accommodation unit is removable from the paper stock processing device and the paper stock processing device is configured to determine and signal that the accommodation unit has been removed from the paper stock processing device when the strength of the magnetic field sensed by the magnetic field-detecting element becomes zero.

5. The paper stock processing system according to claim 1, wherein the external device comprises a management server and the paper stock processing system includes a plurality of paper stock processing devices in data-transmitting communication with the management server, each of the paper stock processing devices has associated therewith 1) a removable accommodation unit that accommodates therein a stack of individual sheets of paper stock, with the maximum number of individual sheets associated with each of the accommodation units being independently set in the setting information storage unit, and 2) an RFID tag storing therein identification information for the associated removable accommodation unit and the accumulated number of individual sheets of paper stock accommodated in the associated accommodation unit, each of the paper stock processing devices transmitting to the management server the identification information for the associated removable accommodation unit and the accumulated number of individual sheets of paper stock accommodated in the associated accommodation unit;

the management server includes a storage unit that stores therein, for each of the paper stock processing devices in the system, the identification information and the accumulated number of individual sheets of paper stock accommodated in the associated accommodation unit;

the center controller determines whether the accumulated number of individual sheets of paper stock accommodated in the accommodation unit associated with each of the paper stock processing devices in the paper stock processing system has reached the maximum number of individual sheets associated with the accommodation units; and when, for each paper stock processing device in the paper stock processing system, the accumulated number of individual sheets of paper stock accommodated in the accommodation unit associated with the paper stock processing device reaches the maximum number of individual sheets associated with the accommodation unit, the center controller issues a warning signal.

6. The paper stock processing system according to claim 5, wherein the warning signal includes the identification information for the removable accommodation unit which has reached it associated maximum number of individual sheets.

7. A paper stock processing device comprising:

a reader unit configured to read information from individual sheets of paper stock inserted into an insertion slot;

an accommodation unit configured to accommodate a stack of the individual sheets of paper stock read by the reader unit;

a storage unit configured to store an accumulated number of the individual sheets of paper stock accommodated in the accommodation unit;

a control unit configured to update the accumulated number stored in the storage unit each time an individual sheet of paper stock is accommodated in the accommodation unit; and a transmitter configured to transmit a warning signal to an external apparatus when the accumulated number updated by the control unit reaches a limitation number set for the accommodation unit;

wherein the accommodation unit additionally includes a magnetic sensor that is arranged to detect the size of the stack of individual sheets of paper accommodated in the accommodation unit, the magnetic sensor being configured and arranged such that the strength of a magnetic field sensed by the magnetic sensor varies as the size of the stack of individual sheets of paper accommodated in the accommodation unit varies; and wherein the accommodation unit is removable from the paper stock processing device and the paper stock processing device is configured to determine and signal that the accommodation unit has been removed from the paper stock processing device when the strength of the magnetic field sensed by the magnetic sensor becomes zero.

* * * * *